US010357676B2

(12) United States Patent
Ben Meir

(10) Patent No.: US 10,357,676 B2
(45) Date of Patent: Jul. 23, 2019

(54) BI-DIRECTIONAL DEVICE AND METHODS OF ITS USE

(71) Applicant: Ilan Ben Meir, Ra'anana (IL)

(72) Inventor: Ilan Ben Meir, Ra'anana (IL)

( * ) Notice: Subject to any disclaimer, the term of this patent is extended or adjusted under 35 U.S.C. 154(b) by 0 days.

(21) Appl. No.: 15/544,355

(22) PCT Filed: May 26, 2016

(86) PCT No.: PCT/IL2016/050547

§ 371 (c)(1),
(2) Date: Jul. 18, 2017

(87) PCT Pub. No.: WO2017/203503

PCT Pub. Date: Nov. 30, 2017

(65) Prior Publication Data

US 2018/0214728 A1 Aug. 2, 2018

Related U.S. Application Data

(63) Continuation-in-part of application No. PCT/IL2016/050059, filed on Jan. 18, 2016.
(Continued)

(51) Int. Cl.
*A63B 5/11* (2006.01)
*A63G 31/00* (2006.01)
(Continued)

(52) U.S. Cl.
CPC ..... *A63B 5/11* (2013.01); *A47D 11/005* (2013.01); *A47D 13/063* (2013.01); *A63G 31/00* (2013.01);
(Continued)

(58) Field of Classification Search
CPC .... A63B 5/00; A63B 5/08; A63B 5/10; A63B 5/11; A63B 5/12; A63B 5/16; A63B 6/00; A63B 6/02
See application file for complete search history.

(56) References Cited

U.S. PATENT DOCUMENTS

D187,138 S 2/1960 Highberger
3,031,688 A 5/1962 Robert
(Continued)

FOREIGN PATENT DOCUMENTS

CN 2357758 Y 1/2000
CN 201022927 Y 2/2008
(Continued)

OTHER PUBLICATIONS

U.S. Appl. No. 62/104,784, filed Jan. 18, 2015, Meir.
(Continued)

*Primary Examiner* — Garrett K Atkinson
(74) *Attorney, Agent, or Firm* — Dorsey & Whitney LLP

(57) ABSTRACT

This presently disclosed subject matter is directed to a bi-directional toy configured to be used as a trampoline and further to be used, upon turning said bi-directional toy upside down, in at least one of the following functions: a playpen-like device, a water pool, and a sphere pool. The toy comprises at least a frame with a plurality of legs configured to elevate the trampoline from a base surface; a bounce mat configured to allow usage of the toy as a trampoline; and the encircling member configured to be attached to the legs for creating a delimited area for use in at least one of the functions.

11 Claims, 19 Drawing Sheets

Related U.S. Application Data

(60) Provisional application No. 62/104,787, filed on Jan. 18, 2015.

(51) Int. Cl.

| | |
|---|---|
| ***A47D 13/06*** | (2006.01) |
| ***E04H 4/00*** | (2006.01) |
| ***A47D 11/00*** | (2006.01) |
| ***A63B 9/00*** | (2006.01) |

(52) U.S. Cl.
CPC ..... *E04H 4/0056* (2013.01); *A63B 2009/008* (2013.01); *A63B 2208/03* (2013.01); *A63B 2208/12* (2013.01); *A63B 2210/50* (2013.01)

(56) References Cited

U.S. PATENT DOCUMENTS

| | | | | | |
|---|---|---|---|---|---|
| 3,734,496 | A * | 5/1973 | Rubin | A63B 5/11 | 182/139 |
| 3,779,201 | A * | 12/1973 | Spahn | B63B 1/047 | 280/206 |
| 4,037,835 | A * | 7/1977 | Forsyth | A63B 5/11 | 248/346.5 |
| 5,385,518 | A * | 1/1995 | Turner | A63B 5/11 | 482/23 |
| 5,592,702 | A | 1/1997 | Gillebaard | | |
| 5,637,057 | A * | 6/1997 | Collura | A63B 5/11 | 482/27 |
| 5,810,695 | A * | 9/1998 | Sass | A63B 5/11 | 441/37 |
| 6,053,845 | A * | 4/2000 | Publicover | A63B 5/11 | 482/27 |
| 6,071,213 | A * | 6/2000 | Raasch | A63B 5/11 | 220/9.4 |
| 6,447,426 | B2 * | 9/2002 | Peterson | A63B 5/11 | 114/311 |
| 6,508,682 | B1 * | 1/2003 | Clark | B63B 7/08 | 441/131 |
| 6,939,270 | B2 | 9/2005 | Wang et al. | | |
| 7,833,132 | B2 * | 11/2010 | Hylbert | A63B 5/11 | 482/27 |
| 8,047,967 | B1 | 11/2011 | Teng | | |
| 2003/0064861 | A1 * | 4/2003 | Chen | A63B 5/11 | 482/27 |
| 2004/0107491 | A1 * | 6/2004 | Publicover | E04H 4/0018 | 4/498 |
| 2008/0090704 | A1 | 4/2008 | Denis et al. | | |
| 2009/0181827 | A1 * | 7/2009 | Hylbert | A63B 5/11 | 482/29 |
| 2009/0260148 | A1 * | 10/2009 | Chen | E04H 4/0025 | 4/506 |
| 2009/0264042 | A1 * | 10/2009 | Chen | A63G 31/12 | 446/221 |
| 2010/0035730 | A1 * | 2/2010 | Dukart | A63B 5/11 | 482/27 |
| 2010/0229296 | A1 * | 9/2010 | Samuel | E04H 4/0025 | 4/506 |
| 2013/0210590 | A1 | 8/2013 | Publicover et al. | | |
| 2015/0080186 | A1 | 3/2015 | Carlin et al. | | |
| 2015/0290485 | A1 | 10/2015 | Depalma | | |
| 2016/0136473 | A1 | 5/2016 | Chen | | |
| 2017/0333741 | A1 * | 11/2017 | Chen | A63B 71/023 | |

FOREIGN PATENT DOCUMENTS

| | | | |
|---|---|---|---|
| CN | 201832323 | U | 5/2011 |
| DE | 202011001354.5 | U1 | 3/2011 |
| GB | 2428596 | A | 2/2007 |
| GB | 2496313 | A | 5/2013 |
| JP | 5919078 | B2 | 4/2016 |
| WO | WO2011032173 | | 3/2011 |
| WO | WO2011032173 | A2 | 3/2011 |
| WO | WO2016113746 | | 7/2016 |

OTHER PUBLICATIONS

International Search Report and Written Opinion from International Application No. PCT/IL2016/050547 dated Sep. 21, 2016.
International Search Report and Written Opinion from International Application No. PCT/IL2016/050059 dated Apr. 21, 2016.

* cited by examiner

BI-DIRECTIONAL DEVICE AND METHODS OF ITS USE

TECHNOLOGICAL FIELD

The presently disclosed subject matter is directed to a bi-directional device having a trampoline use and a non-trampoline use.

BACKGROUND

One example of a bi-directional device to which the presently disclosed subject matter refers is disclosed in U.S. Pat. No. 6,071,213, the device being in the form of a trampoline, which when turned over, can be used as a swimming pool.

GENERAL DESCRIPTION

The present presently disclosed subject matter is directed to a bi-directional device that is configured and operable to change forms and to be used both as a trampoline, and at least one of a playpen-like device, a sphere pool, a water pool, and the like, upon attaching/detaching a handle, if connected, and turning the device upside down as will be described in details below. For simplicity of the description, all reference hereinbelow to a playpen further apply, mutatis mutandis, to any other functional form of the device on the same direction except the trampoline form. The 'bi-directional device' described herein may also be referred in the text below as a 'multifunctional' trampoline and also as a 'multifunctional' or 'bi-directional' toy, thus, these terms are used hereinbelow interchangeably and they are all meaning the same.

The bi-directional device according to the presently disclosed subject matter has a frame of any appropriate shape, a plurality of legs connected thereto, a bouncing mat held by the frame and an encircling member held by the legs, at least when the device is assembled. In particular, the frame of the trampoline can have any polygonal shape with rounded or otherwise smoothened vertexes, such as for example, a hexagonal, octagonal, pentagonal or square shape, or it can have a continuously curved shape (such as e.g. circular or oval). When the trampoline frame is polygonal, the number of legs corresponds to the number of vertexes in the trampoline frame shape. When the trampoline frame shape is continuously curved, the number of legs can be any one as long as it is not less than three.

In particular, according to one aspect of the presently disclosed subject matter, there is provided a bi-directional device, which at least when assembled comprises:

a frame, a bouncing mat attached to the frame, a plurality of legs each having a proximal end associated with the frame and a distal end spaced from the frame so as to enable holding the frame elevated from a horizontal base surface for using the device as a trampoline, when the distal ends of the legs are in contact with and are supported by the base surface; and an encircling member attached to each of said legs for creating a delimited area to allow non-trampoline functioning of the device, when the device is in a position that the frame is disposed adjacent or on the base surface and the legs protrude upwardly therefrom with their distal ends spaced from the base surface.

In accordance with another aspect of the presently disclosed subject matter, a bi-directional device is provided, configured and operable to be used as a trampoline and further to be used as at least one of the following non-trampoline usages: a playpen, a water pool, and a sphere pool, the device at least when assembled comprising a. a frame;

b. a bouncing mat attached to the frame, c. a plurality of legs each having a proximal end connected to the frame and a distal end spaced from the frame so as to enable holding the frame elevated from a horizontal base surface for using the device as a trampoline, when the distal ends of the legs are in contact with and are supported by the base surface; and d. an encircling member attached to the legs for creating a delimited area to allow non-trampoline functioning of the device, when the device is in a position that the frame is disposed adjacent or on the base surface and the legs protrude upwardly therefrom with their distal ends spaced from the base surface, the encircling member being configured to collapse downwardly by its weight towards the frame when the device is used as a trampoline, to expose for viewing at least a majority of space beneath the bouncing mat and the frame.

The device can be foldable by bringing the legs into a non-operational state. For example, the legs can each constitute a part of a leg assembly configured to allow the leg, when the frame is in a horizontal state, to take a generally vertical state for performing the trampoline or non-trampoline functions of the device, and to take a generally horizontal state to allow the device to be folded into a compact form that is suitable for storing as well as shipping the device from the manufactory to the stores and further for delivering the device from the stores to the buyers houses. Alternatively, the legs can be detachable from the frame, when needed, e.g. for storage or transportation purposes.

The simple and fast folding of the device into a compact flat form is further advantageous when the toy is not being in use at home and should be stored. The ability of the device to be folded into a compact flat form allows to keep the house tidy and to make room for other purposes and articles. The transformation of the device into compact form may be carried out when the device is almost fully assembled (only a handle for the trampoline should be detached if it is connected (optional feature)) to ensure a simple, and instant re-arrangement of the device for playing with minimal engagement and efforts of the adult that prepare the device for use.

The novel multi-functional trampoline provided herein is configured and operable to be sold to the end user in an assembled form, thus the user should only set the device in a desired function position, and click the handle if he desire, when the device is used as a trampoline. The multi-functional trampoline may be designed in different dimensions to allow the buyer a choice according to the space he has available.

In some embodiments of the presently disclosed subject matter, the foldable trampoline may be used by adults either at home or in gyms.

The presently disclosed subject matter in further aspects thereof is directed to a number of features relating to the connection of the encircling member to the legs and/or the legs to the frame and/or the trampoline bounce mat to the frame. One of such aspects relating to the latter connection is an optional barrier separating from a central area of the bounce mat exposed to the user, all elements participating in the connection of the bounce mat to the frame so that these elements are hidden from being accessed by the user. In accordance with this aspect, the trampoline can comprise:

a. a frame with legs;

b. a bouncing mat having a central area and a peripheral area connected to the frame, the central and peripheral areas meeting at merging area;

c. a cover, which at least in a top view of the trampoline, covers the frame with a cover frame portion and covers the peripheral area of the bouncing mat with a cover peripheral portion; and d. a barrier fixed at one end thereof to the merging area of the bouncing mat and at another end thereof to said cover at the area of merger between the central and peripheral portion thereof.

Another aspect is an optional novel hook configured and operable to provide fast and reliable connection between the trampoline bounce mat and the solid frame of the trampoline via a bungee cord looped onto the frame. The hook can be designed in a manner that the approach and departure angles of the cord into and out of the hook minimize the friction between the hook and the cord to avoid any damage that may occur to the cord while bouncing. In particular the hook is configured for holding an elastic rope with minimal friction force to be applied on the rope for preventing damage that may occur to said elastic rope upon usage, said hook comprising: an upper area having a saddle like shape for holding a rope below it, a bottom area for stitching said hook to a fabric to be connected, and a middle area configured to connect between the upper and bottom areas and to provide additional length between said areas to allow convenient sawing of the hook to the fabric and further to allow a convenient threading of the rope through it. Optionally, the approach and departure angles of said elastic rope into said hook and out of said hook are in a range of 30 degree to 70 degree.

Other aspects of the presently disclosed subject matter are described in the Detailed Description part of the present application and defined in the claims.

BRIEF DESCRIPTION OF THE DRAWINGS

Examples illustrative of embodiments of the disclosure are described below with reference to Figures attached hereto. In the Figures, identical structures, elements or parts that appear in more than one Figure are generally labeled with the same numeral in all the Figures in which they appear. Dimensions of components and features shown in the Figures are generally chosen for convenience and clarity of presentation and are not necessarily shown to scale. Many of the Figures presented are in the form of schematic illustrations and, as such, certain elements may be drawn greatly simplified or not-to-scale, for illustrative clarity. The Figures are not intended to be production drawings.

The Figures (Figs.) are listed below.

DETAILED DESCRIPTION OF EMBODIMENTS

Figure 1A:
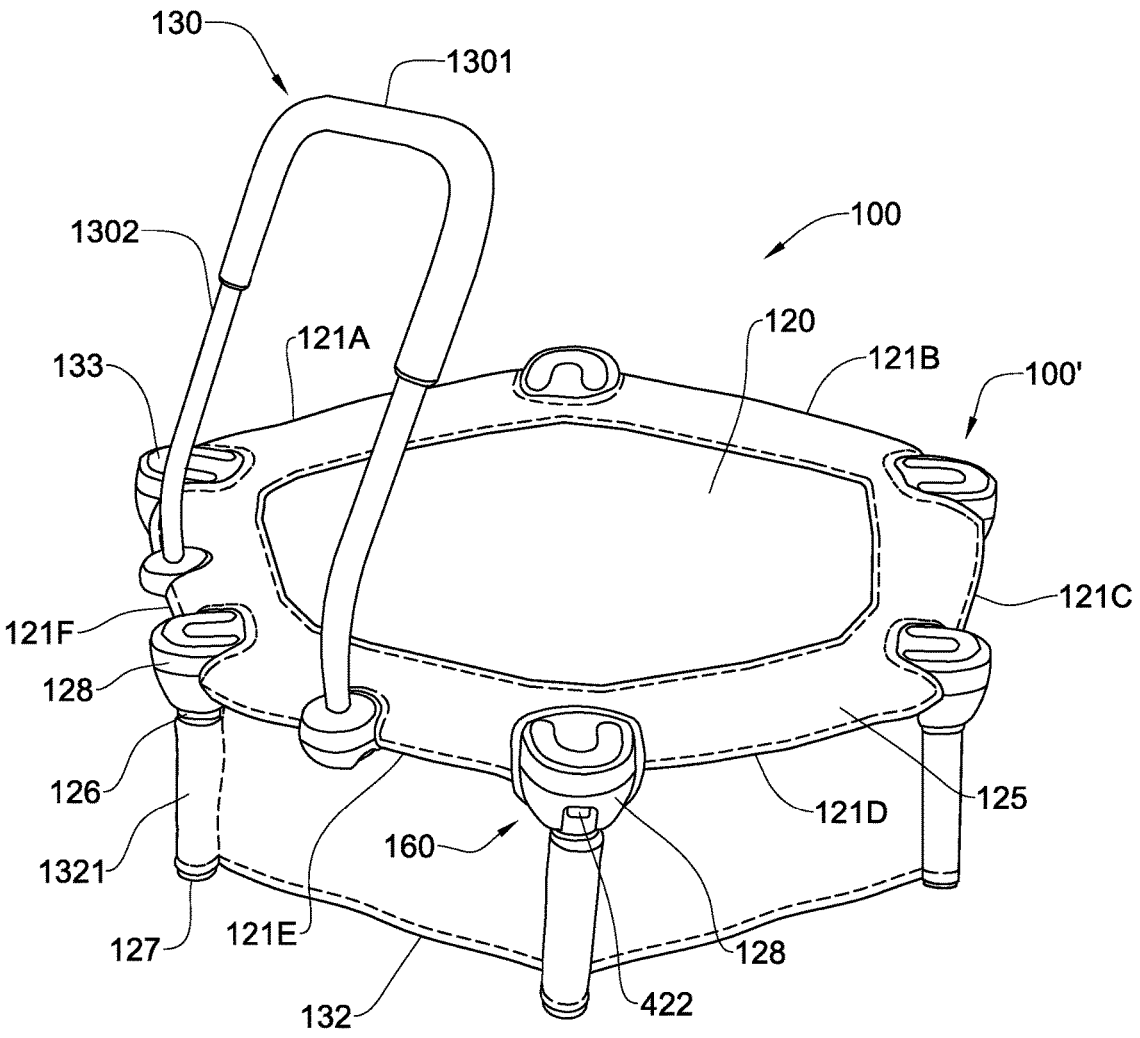
FIG. 1A is a schematic isometric view illustration of a bi-directional toy in accordance with one example of the presently disclosed subject matter.

In the following description, various aspects of a novel multifunctional trampoline according to the aspects referred to above will be described. For the purpose of explanation, specific configurations and details are set forth in order to provide a thorough understanding of the presently disclosed subject matter.

Although various features of the disclosure may be described in the context of a single embodiment, the features may also be provided separately or in any suitable combination. Conversely, although the disclosure may be described herein in the context of separate embodiments for clarity, the disclosure may also be implemented in a single embodiment. Furthermore, it should be understood that the disclosure can be carried out or practiced in various ways, and that the disclosure can be implemented in embodiments other than the exemplary ones described herein below. The descriptions, examples and materials presented in the description, as well as in the claims, should not be construed as limiting, but rather as illustrative.

Terms for indicating relative direction or location, such as "right" and "left", "up" and "down", "top" and "bottom", "horizontal" and "vertical", "higher" and "lower" and the like, may also be used without limitation.

The novel multifunctional trampoline can be easily transformed to a playpen, a baby crib, a sphere pool, and the like by releasing a handle (if connected) and turning the trampoline upside down.

Moreover, even if not transformed as mentioned above, the multifunctional trampoline can be configured for a further use as a tent with a low planar top, for example, when the encircling member is transparent.

The multifunctional trampoline provided herein can be delivered to the end user in an assembled form, thus, reducing the need to engage with assembly of the different components of the trampoline, stretching the bounce mesh properly and connecting it to the frame of the trampoline via a suitable cord, a process that may not be easy to a non-skilled person.

The multi-functionality of the trampoline of the presently disclosed subject matter allows the user not only to save money for buying single-functional products, but also saves the user precious space that is usually a limited and assist in the creation of a calm, tidy surroundings.

The multi-functional trampoline provided herein can be further configured to be folded into a compact form almost in its entirety, a feature that allows substantive costs saving when shipping the toy from the manufactory to the stores and further down the delivery chain of the product to the final destiny of the buyer's house. The folded compact form makes the toy convenient for delivery and cost saving. In addition, it may be inserted into any regular family vehicle for delivery from the store after purchase.

Furthermore, the ability to fold the toy into a compact flat form when it is not in use allows convenient storage at home, as the space occupied by the toy in the folded form is minimized, and it can easily be pushed down the bed or positioned near the wall in a manner that allows open space in the activity area at home or at the yard.

The transformation of the toy from an open form into a compact folded form may be performed when the toy is fully assembled and the only thing that is required to do from the adult handling the toy is to un-click a supporting handle if the trampoline comprises a handle, and such handle is connected. The mechanism allowing the simple transformation from a folded into an open form and vice versa will be described in details below with reference to FIGS. 4-5.

Thus, in accordance with a specific embodiment of the presently disclosed subject matter, a foldable bi-directional toy is provided configured and operable to be used as a trampoline and further to be used as at least one of the following other usages: a playpen, a water pool, and a sphere pool, upon turning over said bi-directional toy, the toy when assembled comprising:

a. a frame having a plurality of leg connection zones;

b. a corresponding plurality of leg assemblies each associated with one leg connection zone and comprising a leg which can be brought into an non-operational state to allow folding of the toy into a compact flat form, and into an operational state, in which the legs are oriented so as to allow elevating the frame from the base surface for use the toy as a trampoline, and to serve as a basis for dressing onto it an encircling member for creating a delimited area when used as at least one of said other usages;

c. a bounce mat mounted to the frame and configured to allow usage of the toy as a trampoline; and d. the encircling member configured to be attached to said legs for creating the delimited area to allow non-trampoline functioning of the toy, when the device is positioned so that the frame is disposed adjacent or on the base surface and the legs protrude upwardly therefrom, the encircling member being configured to collapse downwardly by its weight towards the frame when the device is used as a trampoline, to expose for viewing at least a majority of a space between said bouncing mat and said frame.

The foldable bi-directional toy may further comprises a detachable handle configured to be attached to said frame while using the toy as a trampoline and to be detached from the toy while using the toy in an opposite direction in any of said usages listed above.

The leg assembly can comprise at least a leg with a leg proximal end, a leg distal end and a leg body therebetween, the leg proximal end being associated with a frame engaging member connecting the leg to the frame at one of the leg connection zones, and further comprises a leg folding mechanism configured to:

securely maintain the leg in its vertical position to allow all the legs to elevate the frame and securely hold it in such elevated state for use of the toy as a trampoline, and to protrude upwardly from the frame when the toy is positioned so that the frame is in its lowered state adjacent or on the base surface, thereby enabling at least one of said usages, and allow the leg to take a horizontal position, in which it extends inwardly from the frame, thereby allowing folding of the toy into a compact flat form.

The frame engaging member of each leg assembly can include a housing attached to the frame and accommodating the leg folding mechanism.

The housing can be integrally formed with the frame. Alternatively, the housing can be configured for attachment to the frame. For this purpose the housing can have a top part and a bottom part assembled on the toy frame; and said leg folding mechanism can be disposed within said housing and include a locker having a release trigger button, said locker being to allow folding of the leg toward the center of the toy from the vertical position relative to the toy frame into the horizontal, flat position and a pin configured to allow movement of the leg upward and downward so as to allow folding of said leg. The leg can have a narrow upper portion including its proximal end, suitable for insertion of said locker into it and having dedicated holes for insertion of said pin through it, said narrow portion of the leg together with said locker and pin are all inserted into said housing; wherein, for transforming said toy into a folded flat form, each of said legs is turned from its vertical position (which can hereinafter be also referred to as an 'open' position) to it horizontal position (which can hereinafter be also referred to as a 'folded' position).

The folding of each leg of the bi-directional toy can be obtained upon pressing on said release trigger button of the locker, pulling of the leg out of said housing and then folding the leg inward toward the center of said bounce mat.

In some embodiments, the bounce mat can comprise a plurality of connecting means for connecting the bounce mat to said frame via an elastic rope. Preferably, the connecting means are hooks configured to hold said elastic rope with minimal friction force applied on it in order to avoid damage to said elastic rope upon usage.

In a specific embodiment, the approach and departure angles of the elastic rope into said hook and out of said hook can be in the range of 30 degree to 70 degree to prevent damage that may occur to the rope.

In accordance with a further specific embodiment of the presently disclosed subject matter, there is also provided a foldable bi-directional toy configured and operable to be used as a trampoline and further to be used as at least one of the following usages: a playpen-like device, a water pool, and a sphere pool, upon turning over said bi-directional toy, the toy comprising:

a. a frame defining a trampoline plane and having a number n of leg connection zones;

b. n leg assemblies, each assembly having a leg with a leg proximal end, a leg distal end and a leg body therebetween, the leg proximal end being associated with a frame engaging member connecting the leg to the frame at one of the leg connection zones, and further having a leg folding mechanism configured to securely maintain the leg in its vertical position, in which the leg distal end is spaced from the trampoline plane and the distal ends of the other legs to a maximal extent, to allow all the legs to elevate the frame and securely hold it in such elevated state for use of the toy as a trampoline, and to protrude upwardly from the frame when the toy is turned over and the frame is in its lowered state, thereby enabling at least one of said usages, and allow the leg to take a horizontal position, in which its distal end is spaced from the trampoline plane and from the distal ends of the other legs to a minimal extent, thereby allowing folding of the toy into a compact flat form;

c. a bounce mat securely held by the frame so as to allow usage the mat as a trampoline when the frame is in the elevated state; and d. an encircling member having side walls meeting at least along a part of their height at n corners, each corner being configured to be attached to one of the legs for the encircling member to create a delimited area to allow non-trampoline functioning of the device, when the device is positioned so that the frame is disposed adjacent or on the base surface and the legs protrude upwardly therefrom with their distal ends spaced from the base surface, the encircling member being configured to collapse downwardly by its weight towards said horizontal base surface when the device is used as a trampoline, to expose a space beneath said bouncing mat for being viewed.

The leg distal end and the leg body can be free of permanent fixation to any other leg assembly or to the frame.

The encircling member can be made of fabric or any other flexible material, which can be stretchable. In some embodiments of the presently disclosed subject matter, the encircling member can comprise a number of sleeves corresponding to the number of leg assemblies, each configured to be dressed onto a corresponding leg for obtaining delimited fenced area within the toy.

When the encircling member is formed with side walls meeting at least along a part of their height at corners, it can further comprise sleeves each extending along its corresponding corner and protruding outwardly therefrom. The number of the corners and length of the walls therebetween correspond, respectively, to the number of the legs and spacing between the legs.

The encircling member can be configured to extend only along the periphery of said bounce mat, leaving the remainder of its bottom side surrounded by the encircling member to serve as the floor of said playpen and/or sphere pool.

Each corner of the encircling member can have a distal corner end, which when the encircling member is attached to one of the legs, is fixed to the leg at a fixation location thereof adjacent the distal end of the leg.

Each corner of the encircling member can further have a proximal corner end provided with an embracing element to freely surround the leg so as to be freely movable therealong between a first location taken thereby when the toy is oriented for its non-trampoline use, in which proximal corner end is spaced to a maximal extent from the distal corner end and a second location taken by the proximal corner end when the toy is oriented for its trampoline use, in which the proximal corner end is disposed close the distal corner end, i.e. is spaced from the latter to a minimal extent to expose a space beneath said bouncing mat for being viewed.

In a specific embodiment, the encircling member can be made of a waterproof material and configured to cover said the bottom side of the bounce mat in its entirety so as to allow filling of water into it to be used as a water pool.

A further embodiment of the presently disclosed subject matter is directed to a hook for holding an elastic rope with minimal friction force to be applied on the rope for preventing damage that may occur to said elastic rope upon usage, said hook comprising: an upper area having a saddle like shape for holding a rope below it, a bottom area for stitching said hook to a fabric to be connected, and a middle area configured to connect between the upper and bottom areas and to provide additional length between said areas to allow convenient sawing of the hook to the fabric and further to allow a convenient threading of the rope through it.

Preferably, the approach and departure angles of said elastic rope into said hook and out of said hook are in a range of 30 degree to 70 degree.

Yet, in a further embodiment, the presently disclosed subject matter is directed to a method for folding a bi-directional toy into a flat compact form, said bi-directional toy is configured to be used as at least one of a trampoline, a playpen, a sphere pool, and a water pool, said toy comprising a double safety locking mechanism operated by leg assembly having a release trigger button, said method comprising: a) pressing said release trigger button to unlock a pin for enabling movement of the leg upward and downward; b) pulling said leg out of a housing that holds the leg in when it is in an open position; and c) bending said leg from a vertical position to a horizontal position.

The bidirectional toy suitable for applying this method comprises at least the following: a) a frame having leg connection zones; b) a leg assembly connected to each leg connection zone of the frame and configured to allow folding of the toy into a compact flat form, to elevate the trampoline from the base surface for enabling jumping, and to serve as a basis for dressing onto it an encircling member for creating a delimited area when used as at least one of said usages; said leg assembly comprises at least: a housing having a top part and a bottom part assembled on the leg connection zone of the trampoline frame; a locker having a release trigger button to allow folding of a leg toward the center of the trampoline from a vertical position relative to a flat horizontal position; a pin configured to allow movement of the leg upward and downward so as to allow ejecting of the leg from said housing and folding it in a perpendicular axis; and the leg having a narrow upper portion suitable for insertion of said locker into it and having dedicated holes for insertion of said pin through it, wherein said narrow portion of the leg together with said locker and pin are all inserted into said housing; c) a bounce mat configured to allow usage of the toy as a trampoline; and d) an encircling member having a polygonal shape configured to be attached to each of said legs for creating said delimited area when used as at least one of said usages.

Yet, in a further embodiment this presently disclosed subject matter is directed to a foldable trampoline having a fast opening/folding mechanism allowing a user to transform the trampoline from an open form into a flat folded form and vice versa said trampoline comprises at least:

a. a frame having with a plurality of leg connection zones spaced from each other;
b. a leg assembly connected to each of the leg connection zones and configured to allow folding of its leg from a vertical position into a compact flat form; and
c. a bounce mat attached to the frame and configured to allow usage of the toy as a trampoline when the legs thereof are in said vertical position.

The leg assembly of the foldable trampoline can comprise at least a housing having a top part and a bottom part assembled on the trampoline frame; a locker having a release trigger button to allow folding of the leg toward the center of the trampoline from a vertical position relative to a flat horizontal position; a pin configured to allow movement of the leg upward and downward so as to allow ejecting of the leg from said housing and folding it in a perpendicular axis; and the leg having a narrow upper portion suitable for insertion of said locker into it and having dedicated holes for insertion of said pin through it, wherein said narrow portion of the leg together with said locker and pin are all inserted into said housing.

The foldable trampoline can further comprise an encircling member configured to be attached to said legs of the trampoline when they are in the vertical position and while the trampoline is turned over so that the frame is disposed adjacent or on the base surface for creating a delimited area within said trampoline legs for usage as at least one of the following usages: a playpen, a water pool, and a sphere pool.

The foldable trampoline can comprise a double safety locking mechanism that requires from a user for folding a leg to first press a release trigger button and then pull the leg out of said housing and bend it toward the center of the trampoline, from a vertical position to horizontal position. The track of the leg during folding is similar to "L" shape track.

To re-open the leg from the folded form, the leg should be aliened to a vertical position on top of said housing and be clicked into the housing while applying force.

Following is a description, by way of non-limiting examples only and with reference to the accompanying Figures, which are diagrammatic representations of exemplary methods of carrying out the current subject matter.

FIGS. 1A to 3B illustrate a multifunctional trampoline 100 in accordance with one example of the presently disclosed subject matter, configured to be placed on a horizontal base surface such as base surface (not shown). Multifunctional trampoline 100 is configured and operable to serve as a trampoline, i.e. to have a trampoline state, and further to be transformed into a playpen 101, i.e. to be used in a transformed state, as will be described in details below. Multifunctional trampoline 100 is viewed in FIG. 1A in a combined state in which the toy is open and positioned with the trampoline function on top, ready to be used, wherein legs supporting the trampoline frame are dressed with an encircling member 132 that functionally creates a delimited area that serves for the other functionalities of the toy (besides the trampoline) when the multifunctional trampoline is inversed.

Figure 1B:
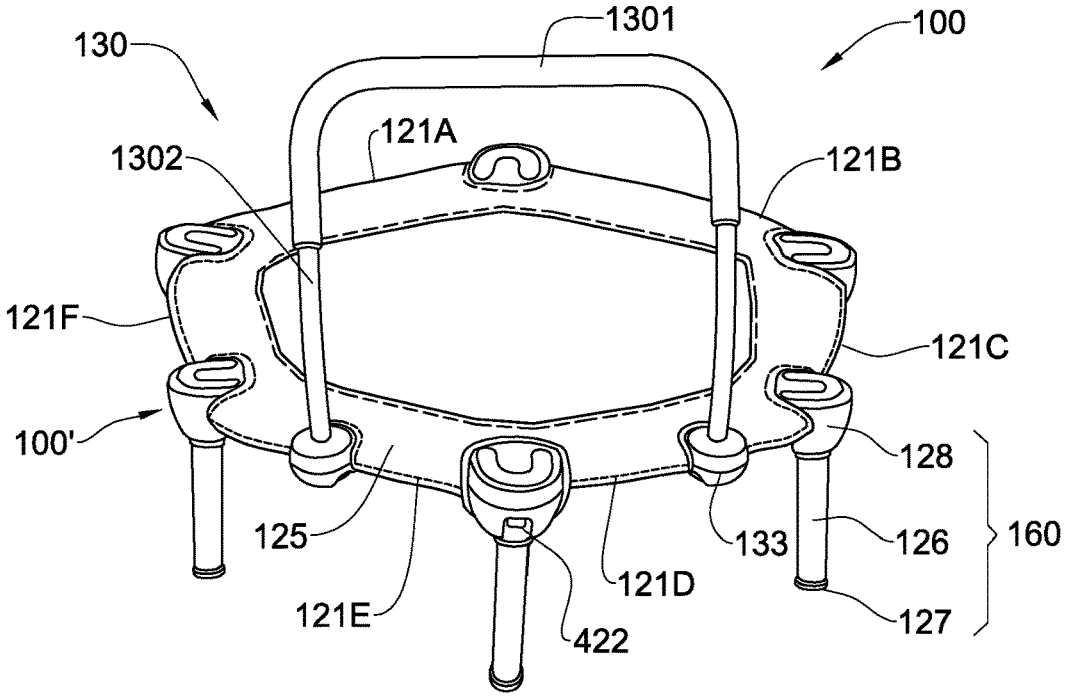
FIG. 1B is a schematic isometric view illustration of the bi-directional toy illustrated in FIG. 1 in a trampoline form.
Figure 1C:
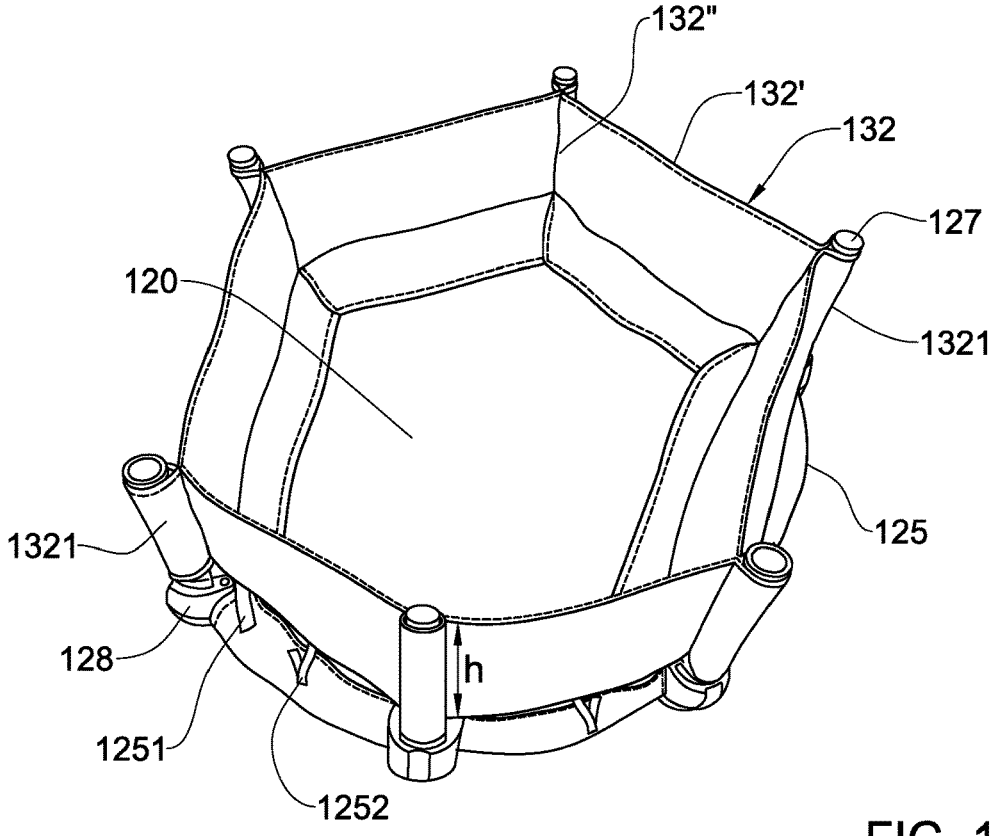
FIG. 1C is a schematic isometric view illustration of the bi-directional toy illustrated in FIG. 1 in a playpen form.

In the specific implementation of the presently disclosed subject matter encircling member 132 comprises side walls 132', each having a height h, meeting at least along a part of their height at corners 132" formed with outer sleeves 1321 (best seen in FIG. 1C). Each sleeve 1321 is configured to be dressed on a leg 126 of the trampoline so as to create a fence, delimiting the area stretched around the inner side of the trampoline frame, in order to be used as either one of a playpen, a water pool, a sphere pool, and the like. The transformation from the trampoline form to the playpen form is simply obtained by un-clicking a handle 130 if the handle is connected to the trampoline (optional feature) and turning the toy over so that the frame is disposed adjacent or on the base surface and the legs protrude upwardly therefrom with their distal ends spaced from the base surface. The legs 126 can be so held in the leg assemblies that, when the toy is open, the spacing between the legs increases in the direction away from the frame, and in this case the length of the walls 132' of the encircling member 132 between the corners 132" can increase accordingly in the direction away from the trampoline frame.

Figure 1D:
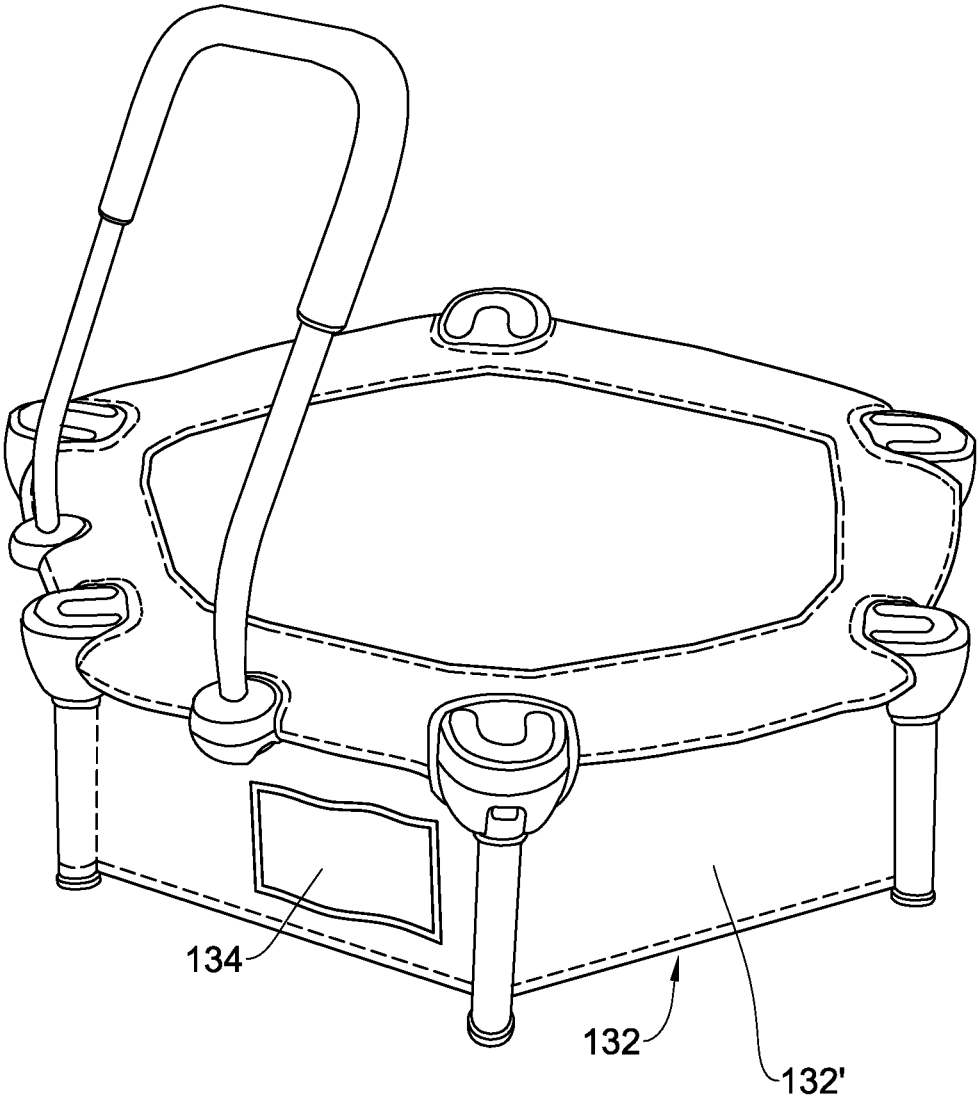
FIG. 1D is a schematic isometric view illustration of a bi-directional toy similar to that illustrated in FIG. 1A, in a form allowing the use of the toy as a tent.
Figure 1E:
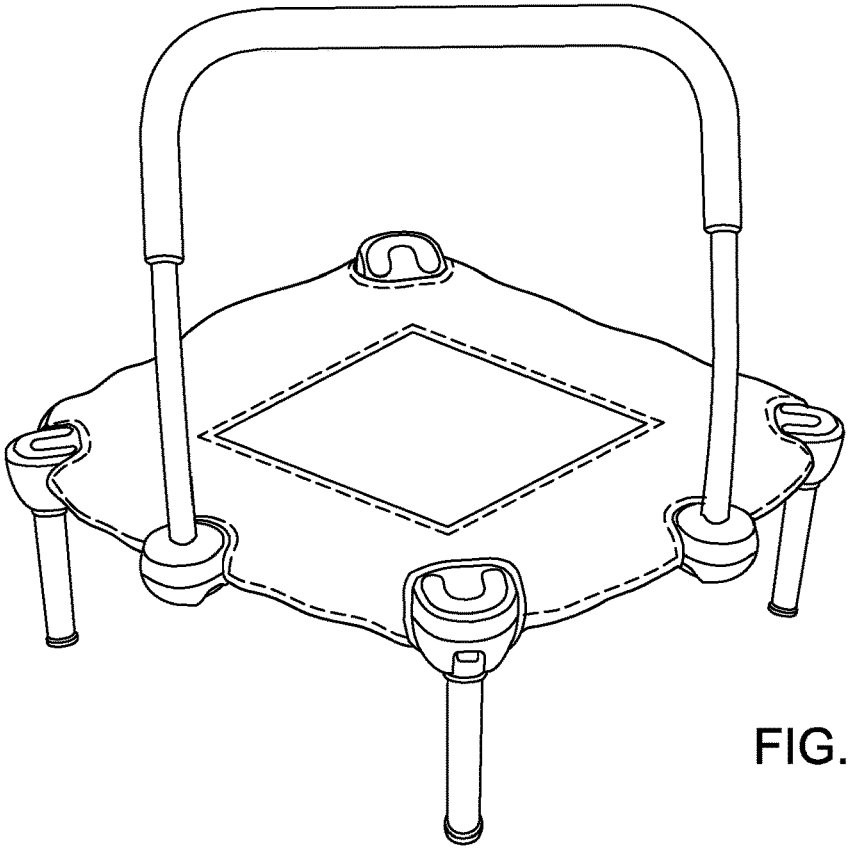
FIGS. 1E and 1F are schematic isometric view illustrations of a bi-directional toy in accordance with another example of the presently disclosed subject matter, in its trampoline and playpen-like forms, respectively.
Figure 1F:
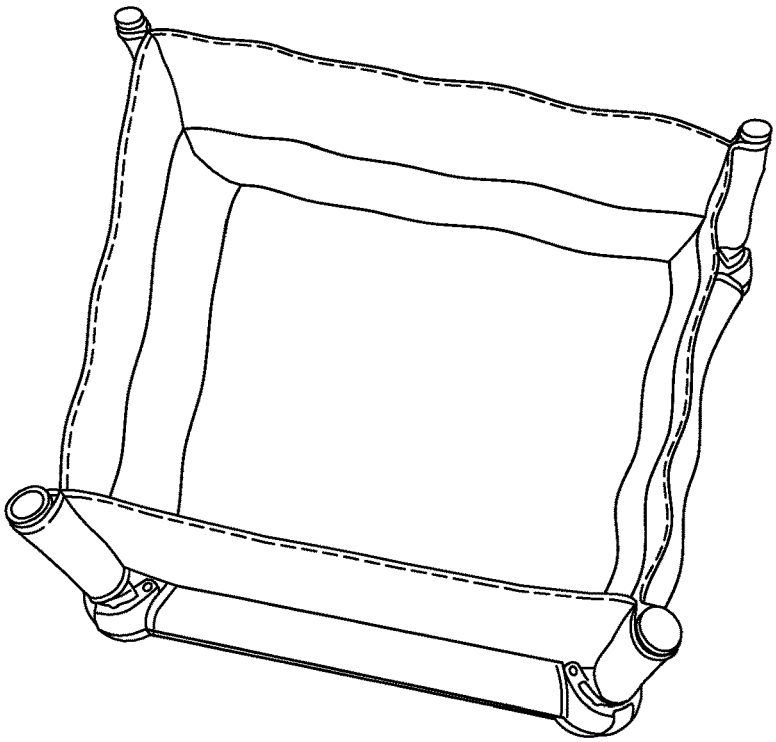
Figure 1G:
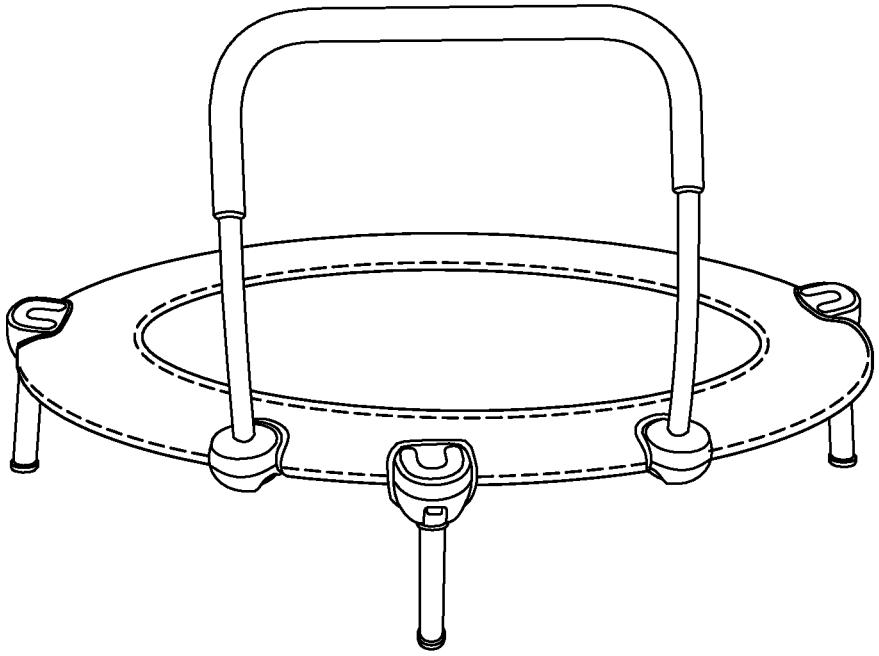
FIGS. 1G and 1H are schematic isometric view illustrations of a bi-directional toy in accordance with a further example of the presently disclosed subject matter, in its trampoline and playpen forms, respectively.
Figure 1H:
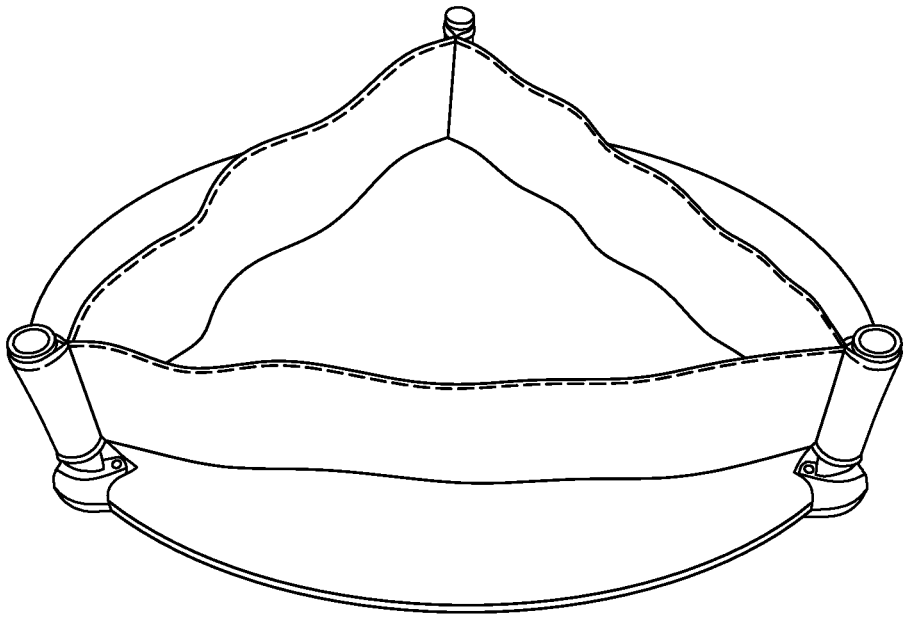

At least one side wall 132' of the encircling member 132 can have an opening with a flapping door 134 as shown in FIG. 1D, allowing the use of the trampoline in its state as shown in this Figure, as a tent with a planar low top. It should be noted that, though the multifunctional trampoline 100 is shown in FIGS. 1A and 1D in a fully assembled state, i.e. with the encircling member in place, such attachment is not required when the system is to be used for its trampoline function, as shown in FIG. 1B.

Multifunctional trampoline 100 comprises a bounce mat 120 connected to a frame 124 (shown in FIGS. 2A and 2B) and a cover 125 (shown in FIGS. 1C, 3A and 3B) configured to hide the frame and also to hide the hooks and bungee rope that are used for connecting the mat to the frame. Cover 125 is preferably but not necessarily made of two layers, wherein the bottom layer is a made of a soft padding textile and the upper layer is a made of a colorful waterproof nylon or leatherette fabric. Thus, it may serve for both aesthetic and safety purposes to provide the toy fashionable look and also protect the child from injuries when he/she falls on frame 124. Bounce mat 120 is preferably made of a breathable fabric that allows passage of water. This character is extremely important when the trampoline is used outdoor to avoid accumulation of rain water on it.

Figure 2A:
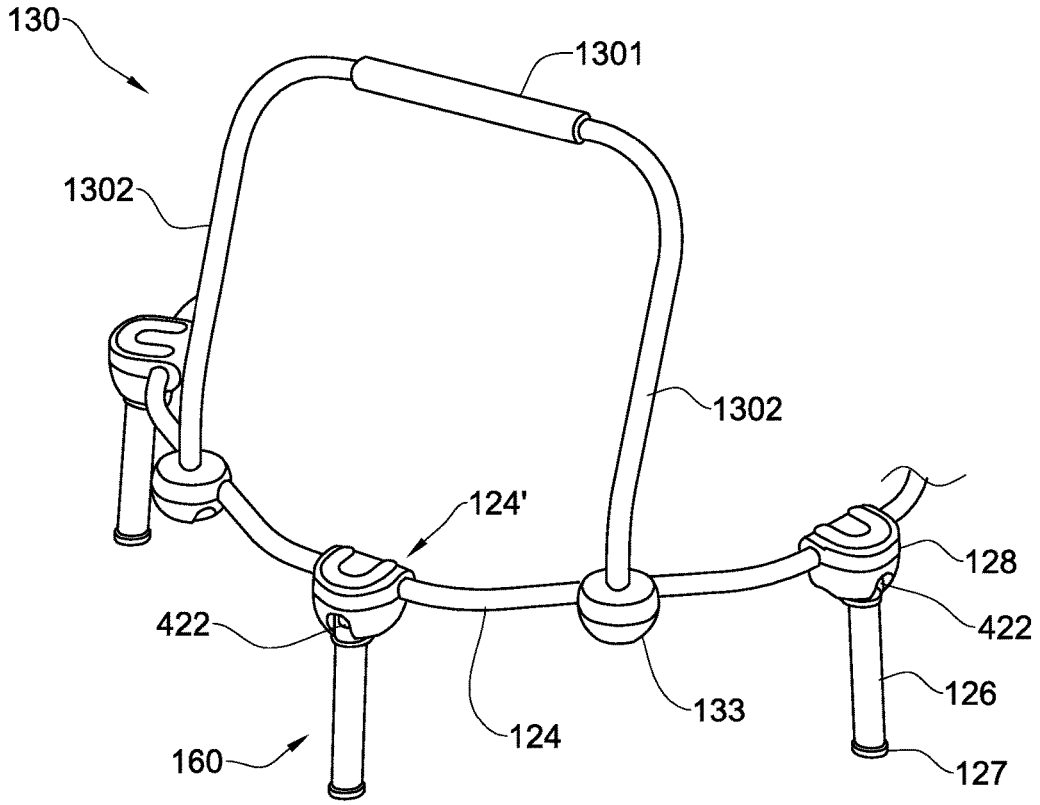
FIGS. 2A and 2B are partial schematic isometric views of a solid frame of the bi-directional toy of FIGS. 1A to 1D in an open state as used in a trampoline form of the toy illustrated in FIG. 1B, and in a folded form as used e.g. when storing the toy, respectively.
Figure 2B:
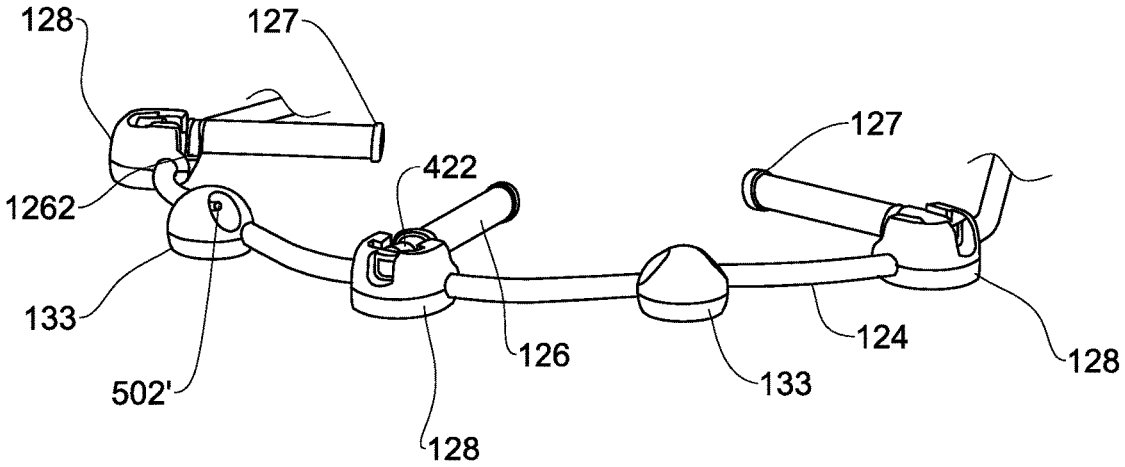

In the specific embodiment illustrated in FIGS. 1A to 3B, multifunctional trampoline 100 has a hexagonal shape, i.e. its frame 124 comprises six sides 121A-121E and six leg connection zones 124' (best seen in FIGS. 2A and 2B). Accordingly, the trampoline 100 comprises a set of six leg assemblies 160, each comprising a leg 126 and a leg folding mechanism within a housing 128 serving as a frame engaging member. Each leg 126 has a proximal end, a distal end and a leg body, and is connected with its proximal end to the frame by the housing 128 that comprises the folding mechanism of said leg. As will be described below, the multifunctional trampoline comprises a double safety locking mechanism, to ensure that the leg will not be folded accidently.

The leg connection zones 124' are spaced from each other to a circumferential distance which is essentially greater than a circumferential extension of each leg connection zone.

It should be emphasized that the trampoline in accordance with the presently disclosed subject matter does not necessarily need to be hexagonal but rather can have alternative trampoline shapes, in which the frame 124 can have any number of leg connection zones 124' and, accordingly, the trampoline can have a respective number of leg assemblies 160, and a respective number of side walls 132' and corners 132" in the encircling member. Non-limiting examples of trampolines having other shapes of their frame are schematically shown in FIGS. 1E to 1H.

The legs may be made of various materials including without limitation, various polymers such as polypropylene, metal, and wood. Optionally, the tip of the leg may be covered by a none-slip pad 127 at the distal end of the leg that is proximal to the floor/base surface that is preferable a plastic/rubber/silicon cover. None-slip pad 127 is configured to protect the leg from abrasion that may result during bouncing and further to protect the floor from scratches that may occur during bouncing.

Optionally, trampoline 100 may further comprise a removable handle 130 configured to provide the child or adult (especially very young children and elderly people) a holding bar to enhance its stability during jumping. The handle may be made of any strong material capable of stably holding the body weight of the child. Handle 130 preferably but not necessarily designed as an inverse "U" shape, having a gripping area 1301 that optionally is covered by a soft material, and two descending arm 1302. In the non-limiting examples illustrated in this Figure, each arm of handle 130 is connected to frame 124 via an extension of the frame shaped as a cylindrical body (shown in FIG. 7C) that is housed within a dedicated connecting body housing 133 that is assembled onto it. Handle 130 may be clicked into the cylindrical body when the toy is used as a trampoline and be unclicked when the toy is turned over to be used as a playpen. Detailed description of the handle, the cylindrical body, and the connecting base housing is illustrated with reference to FIGS. 7A-7C. Also shown in this Figure is release trigger button 422 of leg assembly 160 that is configured to allow the folding of the toy into a flat compact form.

FIG. 1B is a front view illustration of the multifunctional trampoline 100 of FIG. 1A, wherein the encircling member 132 is removed from the legs. In this view legs 126 are uncovered. Shown in this view are bounce mat 120, cover 125, leg assemblies 160 each comprising the leg 126, the housing 128 of the legs folding mechanism with release trigger button 422, and the none-slip pad 127, the six arms of the hexagon shape 121A-121E of the multifunctional trampoline, handle 130 with gripping area 1301 and tubes area 1302, and connecting body housing 133 of the handle connecting mechanism.

FIG. 1C is a top view illustration of the multifunctional trampoline of FIG. 1A in a playpen form 101. In this form of the toy handle 130 is detached from the toy and the trampoline is being inversed to the opposite direction in order to make use of the concave shape of the inverted trampoline to create a playpen or sphere pool for toddlers. As seen in this view the encircling member 132 is dressed onto the trampoline legs to create a close fenced area. This is achieved by dressing the encircling member sleeves 1321, each onto a respective leg. In accordance with implementations of the presently disclosed subject matter the assembly of the encircling member 132 is performed at the manufactory so as to minimize the engagement required for preparing the toy for usage. Preferably, sleeves 1321 are predesigned in dimensions that require applying force when applying them onto the legs to ensure minimal movements. In addition, limiters 1264 at the bottom edge of legs 126 (shown in details in FIG. 4) further insure that the sleeves will remain at their position. Also shown in this view are: bottom side of cover 125 with connecting buckles 1252 and connecting straps 1251 for ensuring a stable connection of the cover to the bounce mat, and bottom side of the leg's folding mechanism in the housing 128. In the example illustrated in this Figure the coverage of encircling member 132 is partial and as such, the bottom of the playpen is actually the bounce mat 120. Alternatively, encircling member 132 may be designed to provide a full coverage of the delimited area including the bottom surface in a manner that covers the entire bounce mat 120. Preferable, encircling member 132 is made of materials that are easy to clean and relatively stable to ensure that it will not be easily torn upon usage. When it is used as a sphere pool or as a playpen it is preferred to use a breathable fabric.

In further embodiments, encircling member 132 may be made of a waterproof material suitable for filling water into it, and as such may be used at this form as a water pool.

FIGS. 2A-2B are partial schematic isometric views of the structural components of the bi-directional toy of FIGS. 1A-1C without the covers and fabrics, in an open ready to use as a trampoline form (2A), and in a folded compact form ready for storage with the folded legs positioned on the top (2B).

Referring to FIG. 2A, frame 124 is uncovered. The frame 124 is preferably made of a rigid material suitable for such purpose such as but not limited to a metal. The housing 128 of the leg's folding mechanism is shown from top. The housing 128 is assembled onto the frame at its rear, while on the front that is facing the surroundings a release trigger button 422 is shown. Leg 126 has a leg proximal end 126', a leg distal end 126" and a leg body therebetween, the leg proximal end being connected to the bottom side of housing 128 by a frame engaging member configured to:

securely maintain the leg in its vertical position, in which the leg distal end is spaced from the trampoline plane and the distal ends of the other legs to a maximal extent, to allow all the legs to elevate the frame and securely hold it in such elevated state for use of the toy as a trampoline, and to protrude upwardly from the frame when the toy is turned over and the frame is in its lowered state, thereby enabling at least one of said usages, and allow the leg to take a horizontal position, in which its distal end is spaced from the trampoline plane and from the distal ends of the other legs to a minimal extent, thereby allowing folding of the toy into a compact flat form; part of the leg is positioned in the open form within the housing as will be described in details with reference to the folding and unfolding mechanism of the trampoline legs.

In the open form view shown in this Figure, handle 130 is attached to the frame. In this specific example, the two edges of the descending tubes 1302 are inserted into connecting bodies' housings 133 each assembled on frame 124.

Housings 133 are located on the frame in a manner that between them the leg assembly 160 is positioned. In other words, leg 126 together with housing 128 is positioned and protruding outward for creating an opposite momentum when jumping on the trampoline. This unique structure stabilizes the trampoline in order to avoid unintentional reversal of the toy while jumping, which is a very popular drawback of prior art trampolines and major cause for injuries of children playing with trampolines. The position of the protruding leg between the two arms of handle 130 is located as opposite support to create leaning support that prevents from the trampoline to tip over during jumping. Also shown in this view are: none-slip pad 127, release trigger button 422, and gripping area 1301.

FIG. 2B illustrates the legs in a folded form while the frame is positioned in opposite direction shown in the open form illustrated in FIG. 2A. At this view, housing 128 of the leg's folding mechanism is viewed from its bottom side, together with release trigger button 422 and a stage 1262 (described in details with reference to FIG. 4 below). Handle 130 is not connected to frame 124, and the legs 126 are folded toward the center of the space encompassed by frame 124. Also shown in this view are: pad 127, and connecting base housing 133 with opening 502' for releasing the handle (described in details with reference to FIGS. 7A-7C below).

Figure 3A:
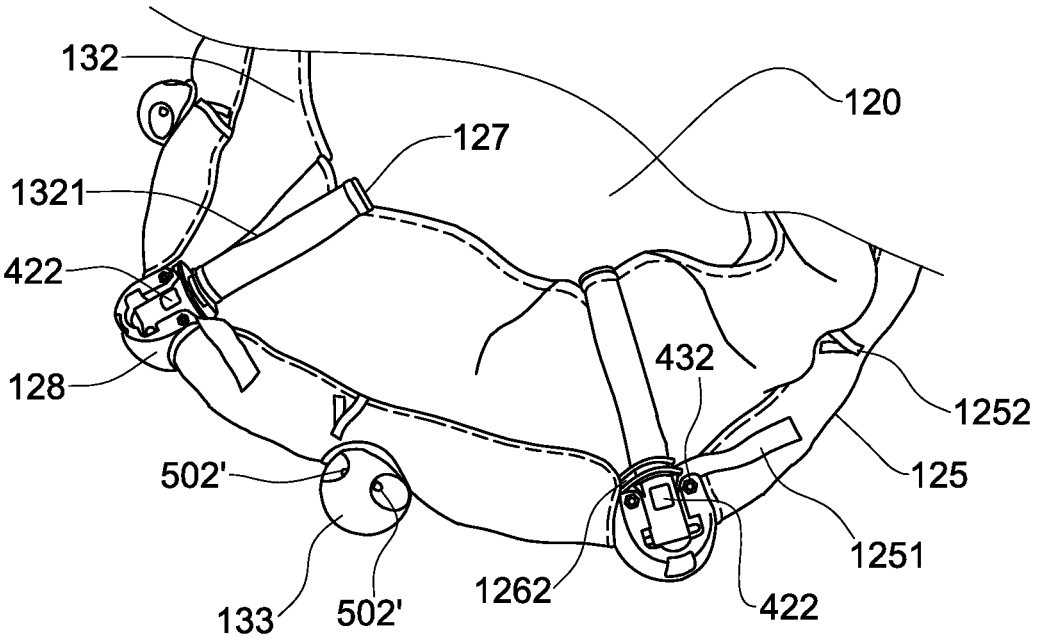
FIGS. 3A and 3B are partial schematic illustrations of the bi-directional toy shown in FIGS. 1A to 1D, in a compact folded form, when folded with its encircling member and when folded without the encircling member, respectively.
Figure 3B:
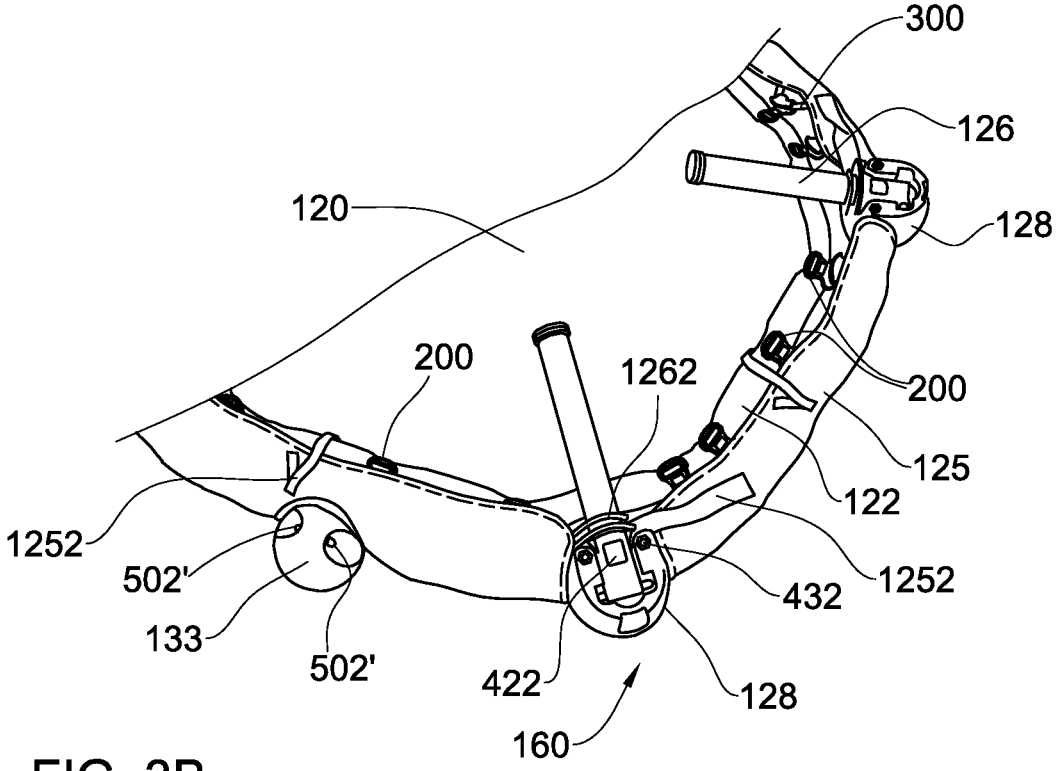

Reference is now made to FIGS. 3A-3B that schematically illustrate the bi-directional toy of the presently disclosed subject matter in the multifunctional form as illustrated in FIG. 1A, and in a trampoline form as illustrated in FIG. 1B respectively, in a compact folded form together with the covers and fabrics.

As seen in the drawings, folding of the trampoline may be performed together with the entire fabrics and covers of the multifunctional trampoline in order to insure minimal engagement with assembling and disassembling of the toy before and after storage. For folding the multifunctional trampoline it is required to detach handle 130, if it is connected to the frame, before folding it. That is to say, that when the toy is used as a trampoline with the handle, the handle should be detached before folding the toy for storage, and when the toy is being used as a playpen or a pool, it is only required to take out objects that were placed inside during playing (if there are such objects) and fold the multifunctional toy without detaching anything. This simple mechanism allows transforming the toy from one form to the others to take less than one minute. In addition, the fact that the folding of the toy is performed with the entire parts that are required for operation (besides the handle) make it easy and fast to reopen the toy for playing and insure that no parts will be lost, as all the components remain attached for safety in the folded form as will be described in details with reference to FIGS. 5A-5B.

When the bi-directional toy is folded after serving as a playpen 101 (FIG. 3A), the legs that are covered with the encircling member sleeves 1321 are folded towered the center of the toy, together with the encircling member 132. Also shown in this view is the bottom side of cover 125. Cover 125 in the example illustrated in this Figure is secured to the frame by Velcro straps 1251 at the leg assembly area and further connecting one or more buckles 1252 at about the center of each arm of the hexagon, however, other attachment mechanism of the cover may be used. The bottom side of the housing 128 of the leg folding mechanism is shown. At this position release trigger button 422 of the leg folding mechanism is shown facing upward. Also shown are: pad 127, screws 432 connecting the leg assembly to the frame, and stage 1262. At this position, connecting base 133 is also shown from the bottom side together with openings 502' for the handle spring (shown in details in FIGS. 7A-7B). At the center of the Figure, bounce mat 120 is shown.

When the encircling member 132 is removed (FIG. 3B) the legs 126 are shown and the connection of bounce mat 120 to the frame is revealed. At this view it can be seen that the bounce mat 120 at the edge is stitched to another webbing textile 122, this webbing is used as an infrastructure for connecting means 200 that at this specific example, are novel hooks that encircle bounce mat 120. Webbing 122 contains such connecting means (hooks) for connecting the bounce mat 120 to the frame. Textile 122 is stitched to hooks 200. Novel hooks 200 will be described in details below with reference to FIGS. 6A-6C. Each hook is configured to hold a cord that is looped over the frame, in order to connect the bounce mat 120 in a stretched manner to the frame to allow jumping on it. In a specific embodiment, the cord is a bungee rope. Also shown in this view are: the leg assembly 160 with leg 126 having stage 1262, none-slip pad 127, and housing 128 together with release trigger button 422 and screws 432, the handle connecting body housing 133 with release button openings 502', cover 125, and straps 1251. Optionally, cover 125 comprising at its bottom side that is shown in this view additional securing means such as connecting buckle 1252 for connecting cover 125 to webbing 122, preferably at the center of each arm 121A to 121E of the hexagon structure of the trampoline, for ensuring that cover 125 will remain connected and stretched over the frame at all times, unless the user wish to remove it purposely, and Velcro straps 1251 around the leg assembly 160. It should be clear that the connection of the bounce mat to the trampoline frame illustrated above is only one none limiting example and the connection between them may be performed by other means including without limitations by other hooks available in the market, by springs or else. In addition, the bi-directional toy illustrated herein may have an integral bounce mat that is permanently attached to the frame or a separated part therefrom that may be attached to the frame by any known means available in the art.

Figure 4:
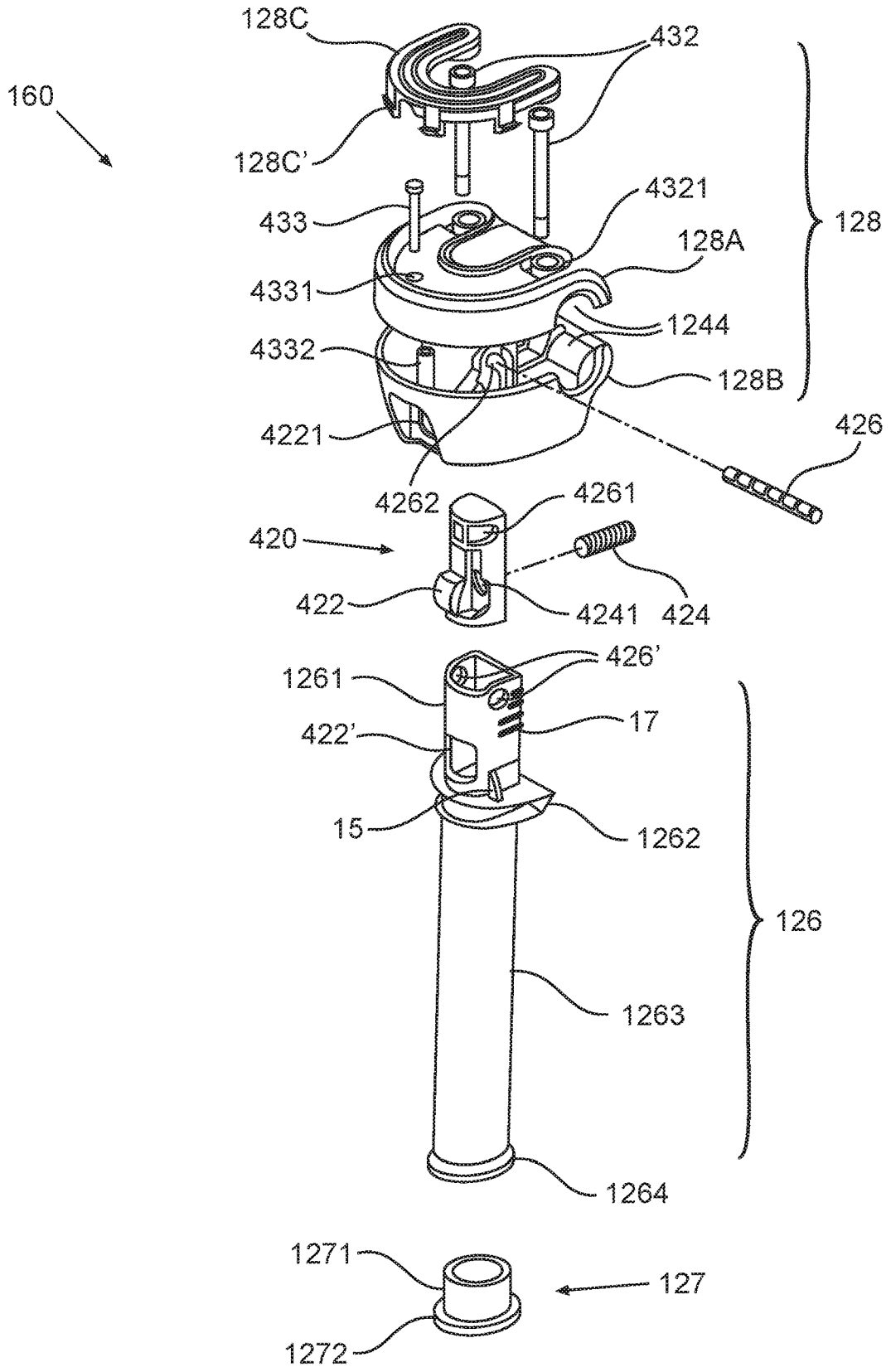
FIG. 4 is a schematic exploded view illustration of a leg assembly of the bi-directional toy illustrated in FIGS. 1A-1C, in accordance with examples of the presently disclosed subject matter.

FIG. 4 is a schematic exploded view illustration of a leg assembly 160 of the bi-directional toy of FIGS. 1A-1C, in accordance with examples of the presently disclosed subject matter. Leg assembly 160 comprises a housing 128, a locker 420, a leg 126, and optionally a none-slip pad 127.

Housing 128 comprises a top housing portion 128A and a bottom housing portion 128B connected to each other, preferably but not necessarily by self-taping screw 433 that is inserted via hole 4331 into a threaded boss 4332 positioned at the bottom housing portion 128B. Additional two screws 432 are inserted via dedicated holes 4321 at the top housing portion 128A through dedicated holes at the trampoline frame 124 (not shown in this view) up to the bottom housing portion 128B. These screws are used for connecting the top portion of housing 128A to the bottom portion of housing 128B using nuts and to fasten both portions onto the trampoline frame 124. At this area, which is the posterior portion of housing 128, each portion comprises a niche 1244 in a half tube shape in a manner that the two niches are facing one another to create a hole in a size suitable to contain frame 124. The top portion of housing 128A as well as the screws are covered by a top rubber cover 128C that is clicked onto top housing portion 128A via snap fit 128C'. Rubber cover is configured to provide both, a softer safer layer if the child accidently fell on it, and also to play an aesthetic role by providing housing 128 a clean look as it covers the screws that are used for the connection of the elements, and also play a role as anti-slip legs when using the toy as sphere pool or swimming pool.

Bottom housing portion 128B further comprises an opening 4221 for release trigger button 422 that is part of locker 420. Locker 420 is inserted into upper portion 1261 of leg 126 and both are inserted into bottom housing 128B.

Leg assembly 160 further comprises a locker 420 having a release trigger button 422 connected to a spring 424. Spring 424 is inserted at one end into locker 420 via opening 4241 at the posterior wall of locker 420 in a vertical position to button 422 and provide it its springiness. Locking 420 further comprises at its upper portion windows 4261 for insertion of a pin 426.

Leg assembly 160 further comprises a leg 126 having a narrow upper portion 1261 that is structurally designed to house locker 420. As such, upper portion 1261 of the leg comprises dedicate opening 422' for release trigger button 422, and openings 426' for pin 426.

The connection area between the upper narrow portion 1261 of leg 126 to the tube portion 1263 of the leg is designed as a protruding stage 1262 that functionally defines the movement range of the leg from an open to a folded form. When the leg transforms from a close form into open form, stage 1262 defines the final stage of the open form of leg 126. Stage 1262 is designed in a complimentary shape and size to an opening in the bottom side of housing 128 such that in an open form of the leg, stage 1262 is elevated upward until it reaches and inserted into the opening in bottom housing 128B. Upper portion 1261 may further comprise ribs such as 15 and 17 in various dimensions and orientations configured to lead leg 126 to a proper position when transformed from a folded to an open form and to stabilize it (i e minimize undesired movement of the leg assembly components). The bottom end of tube portion 1263 comprises a limiter 1264 configured for securing encircling member 132 to its proper position around the leg and preventing its release from the leg.

Preferably but not necessarily, leg assembly 160 comprises a none-slip pad 127. None-slip cover 127 is made of a narrow upper portion 1271 in a diameter suitable to be inserted into the bottom end of leg 126 for establishing a stable connection between them. The narrow portion 1271 ends with a flat base 1272 configured to prevent abrasion of the floor, and also to prevent grinding of the leg itself during usage and further to improve the leg's grip to the floor.

Leg assembly 160 comprises a pin 426 that is configured to move upward and downward and to allow the movement of the leg from an open form into a folded form and vice versa (L shape movement of the leg). Since the locker 420 is configured to be inserted into the upper portion 1261 of the leg and both are configured to be inserted into housing 128, all parts contain dedicated openings for pin 426 to thereby allow its movement. A shown in this Figure, bottom portion of the housing 128B comprises opening 4262 for the pin, locker 420 comprises openings 4261 for the pin, and upper portion 1261 of leg 126 comprises holes 426' for the pin. The folding mechanism of the leg assembly 160 will be described with reference to FIGS. 5A-5B below.

Figure 5A:
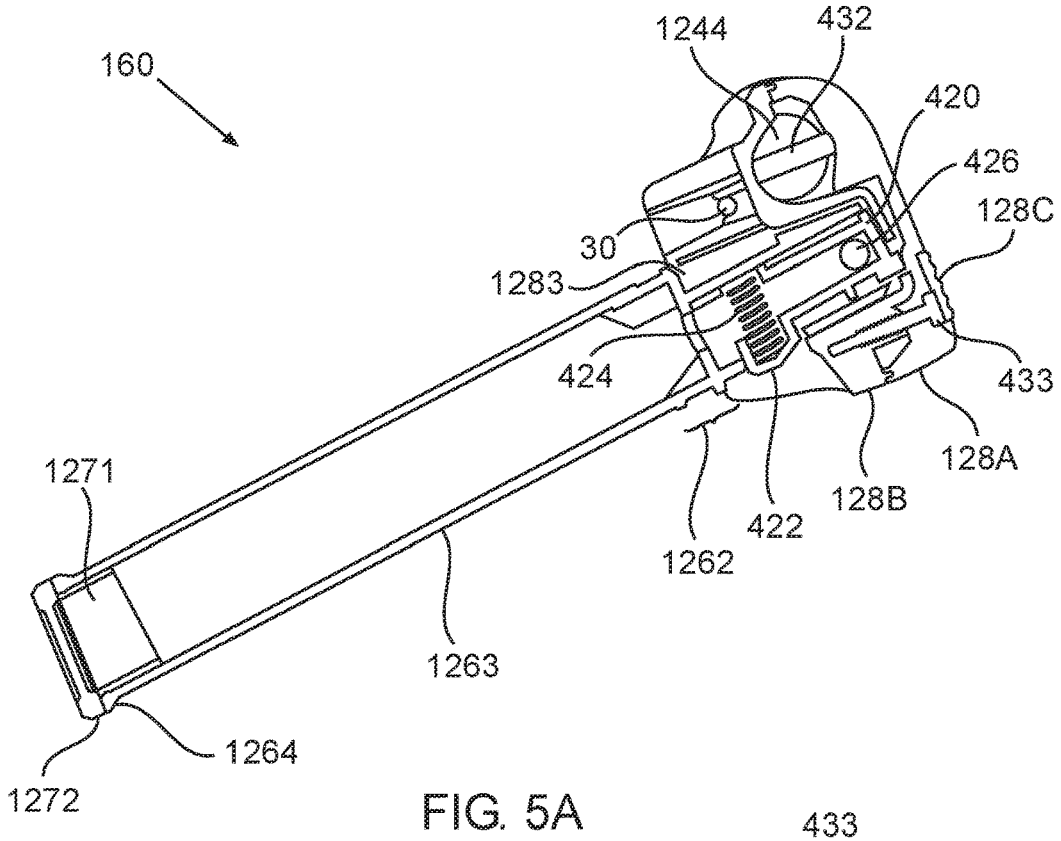
FIGS. 5A and 5B are schematic cross section views of the leg assembly of the bi-directional toy illustrated in FIG. 4 in an open form (FIG. 5A) and in a folded form (FIG. 5B) in accordance with examples of the presently disclosed subject matter.
Figure 5B:
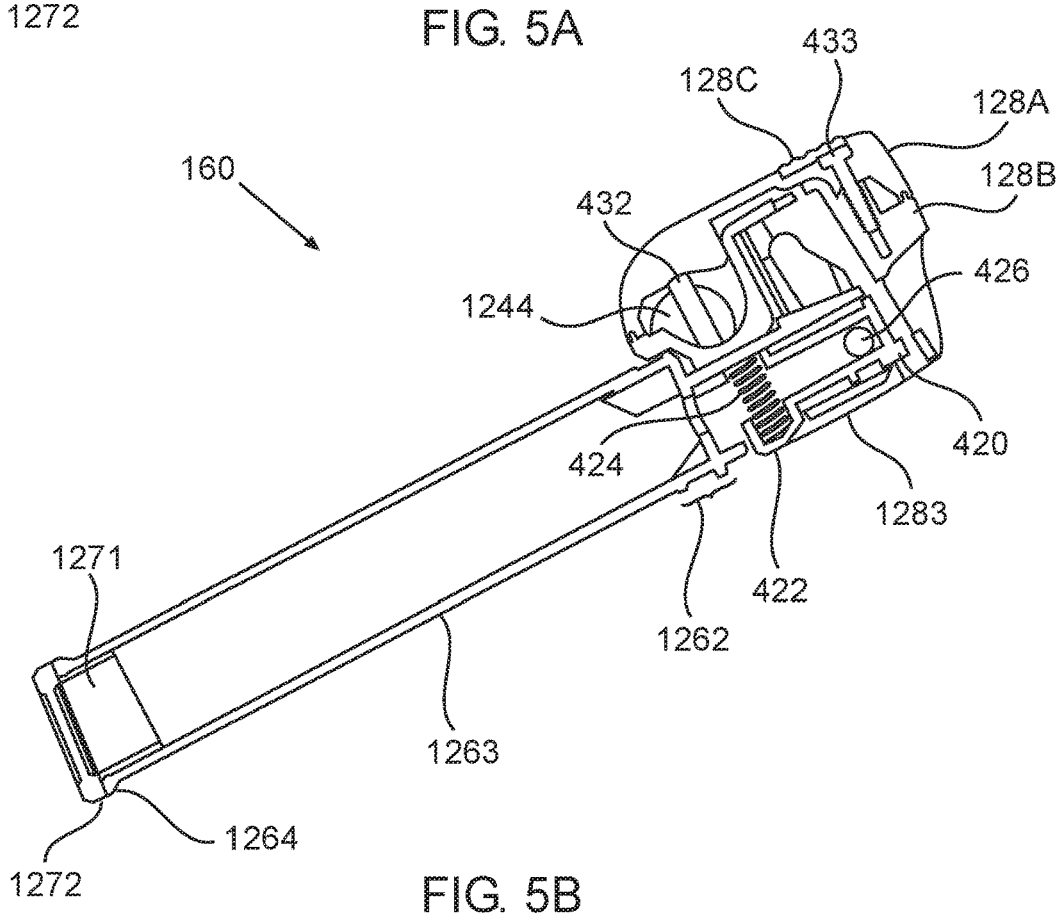

FIGS. 5A-5B are schematic cross section views of leg assembly 160 of FIG. 4 in an open form (FIG. 5A) and in a folded form (FIG. 5B) in accordance with examples of the presently disclosed subject matter.

As mentioned above, the multifunctional trampoline comprises a double safety locking mechanism. Thus, in order to fold leg 126, the user should first press release trigger button 422 of locker 420, pull the leg 126 downward and fold it toward the center of the trampoline, from a vertical position to horizontal position. The track of the leg during folding is similar to "L" shape track. During the folding process of leg 126, upper portion 1261 is pulled down (this is enabled when pressing on button 422), stage 1262 is being distant from the bottom opening of bottom housing 128B and pin 426 is moving downward along space 4262. At this stage leg 126 changes its axis relative to the frame of the trampoline from a vertical position to horizontal position. At this folded position the leg is locked by a plunger 30 (Shown in FIG. 5A).

In order to re-open leg 126 from a folded form, the user should align the leg to a vertical position on top of housing 128 and click it into housing 128 while applying force. When the leg transforms from a close form into an open form, stage 1262 defines the final stage of the open form of leg 126, when it reaches the complementary opening on the bottom side of housing 128B. When stage 1262 is elevated upward reaches the opening in bottom housing 128B and inserted into it, the opening process of leg 126 is completed.

FIG. 5A is a cross section view of the leg assembly 160 when the leg is open. In that form leg 126 is on the same axis with housing 128 (on a continuous imaginary line). The top portion 128A of the housing is connected to bottom portion 128B by screw 433 that is covered by rubber cover 128C. At this form locker 420 together with button 422 and spring 424 are inserted into housing 128 and positioned near the top housing 128A. Stage 1262 at this view is positioned on the bottom opening 1238 of bottom housing 128B and closing it. The medial part of housing 128 that is assembled on frame 124 of the multifunctional trampoline is shown in this view with screw 432 that connects housing 128 and frame 124 in a parallel position to locker 420 and vertical position to spring 422. Below it a plunger 30 is shown in this view that is aimed to support the leg in a folded form to remain stably folded (locked). Also shown in this view are: niche 1244, tube portion 1263 of leg 126, limiter 1264, the narrow portion of none-slip pad 1271 inserted into the bottom end of the leg, and base 1272.

In the folded form illustrated in FIG. 5B, leg 126 is laid onto housing 128 and they are no longer on the same axis as now they are perpendicular one to the other. Connecting screws 432 and 433 are shown in a parallel position to spring 422, and locker 420 is viewed distanced from the top housing 128A and from rubber layer 128C. Pin 426 is at the most bottom point it can range, and the top portion 1261 of leg 126 is out of housing 128. At this view, stage 1262 is positioned near the outer surface of bottom housing 128B away from the bottom opening 1283 where locker 420 and button 422 are now positioned. Also shown in this view are: niche 1244, tube portion 1263 of leg 126, limiter 1264, the narrow portion of none-slip pad 1271 inserted into the bottom end of the leg, and base 1272.

Figure 6A:
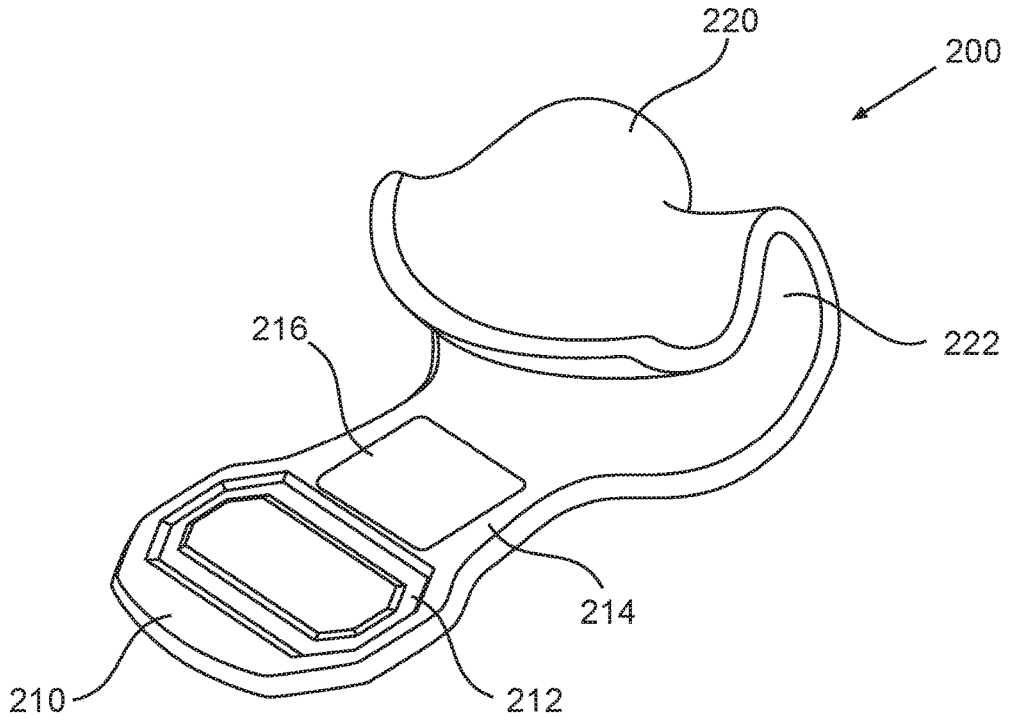
FIG. 6A is a schematic illustration of a novel hook configured and operable to provide fast and reliable connection between the bounce mat and the frame of a bi-directional toy, in accordance with a further example of the presently disclosed subject matter.

FIG. 6A is a schematic illustration of a novel hook 200 configured and operable to provide fast and reliable connection of the bounce mat to the frame of the multifunctional trampoline of the presently disclosed subject matter.

Hook 200 is composed of three main areas: an upper area 220, a bottom area 210, and a middle area 214. Upper area 220 also referred hereinafter as the: "hook's head", has a saddle like shape, and is configured to hold a cord 300. The cord is preferably a bungee rope that is being enwrapped over the trampoline frame and during connection to the hook it is positioned below the saddle like area 222 of hook 200.

Bottom area 210 of hook 200, also referred hereinafter as the: "hooks base" is a flat area and contains a stitching area 212 for stitching the hook to webbing fabric 122 encompassing bounce mat textile 120. Middle area 214 is also flat and serves as a "neck" connecting the head of the hook and the base, providing additional length between the hook's head and the hook's base to allow convenient sawing of the hook to the textile on one hand, and also to allow a convenient threading of the cord through it. Middle area is preferable but not necessarily, narrower that the base area. This area may further be used for positioning of a logo 216 or other symbols within it. It should be clear the novel hook described herein may be used for various different appliances on the same concept described herein and is not limited to the usage described herein.

Jumping on the trampoline is enabled thanks to the elasticity of the bungee rope that stretches when the child is jumping on the bounce mat 120 and then returns to its normal upstretched position. The bounce mat has no elasticity by itself.

The unique structure of the hook's head 220 and the positioning of the bungee rope below the head within area 222 protect the bungee rope from damage that may occur to it during jumping, as the unique structure of the hook minimize friction between the hook and the rope during jumping, and insure long lifetime of the rope. Thus, the safety and reliability of the trampoline as a toy increases relative to other trampolines available in the market that make use of bungee rope.

In addition the unique structure of hook 200 allows simple and quick connection of the bounce mat 120 to the trampoline frame 124 as the bungee rope 300 is first looped over the frame, and afterward the bounce mat is connected to the frame by hooking the looped rope to the hooks stitched to the webbing fabric 122 encompassing bounce mat textile 120.

Figure 6B:
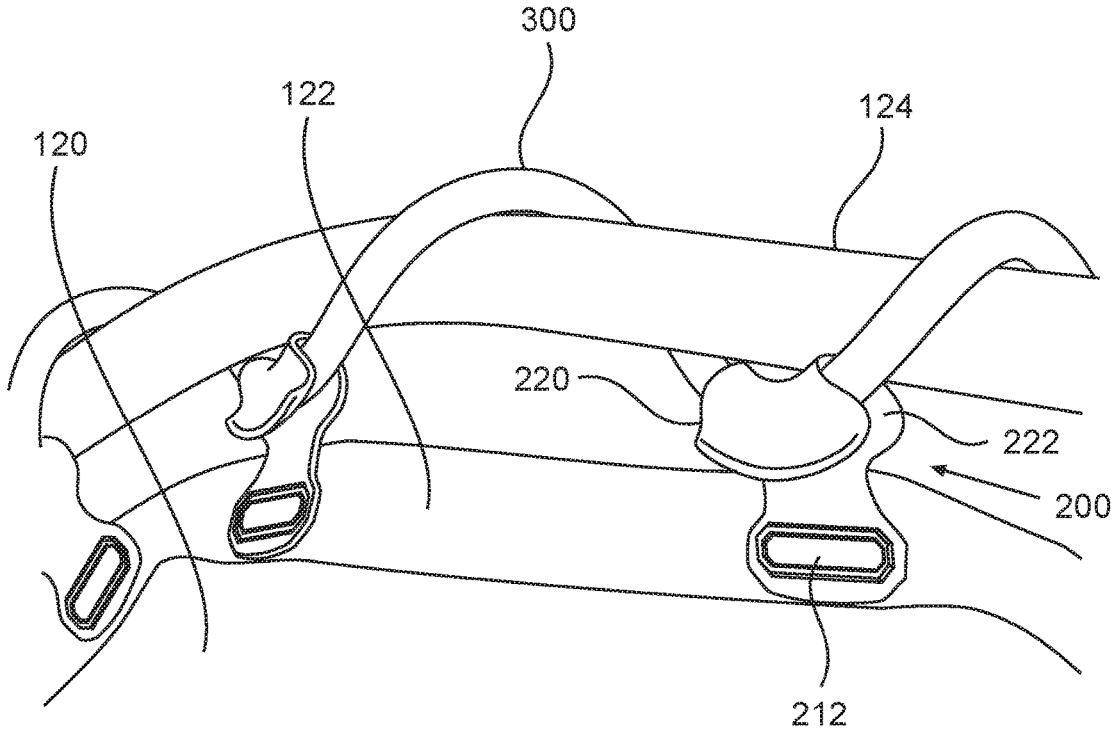
FIG. 6B is a schematic close up view illustration demonstrating usage of the novel hook of FIG. 6A within the bi-directional toy for connecting the bounce mat to the frame via a bungee rope.

FIG. 6B is a schematic close up bottom view illustration demonstrating usage of the novel hook 200 of FIG. 6A within the multifunctional trampoline of the presently disclosed subject matter for connecting the bounce mat 120 to the trampoline frame 124 via bungee rope 300.

When looking at the bottom side of the bounce mat 120, it can be seen that hook 200 is stitched to webbing 122 at area 212. The middle area leads the head of the hook 220 to be positioned beyond the bounce mat edge near the frame, while bungee rope 300 is threaded below the saddle like area 222 of hook, 200 while it is looped over the trampoline frame 124. The positioning of the rope 300 inside area 222 allows smooth movements of the rope when it is stretched with minimal friction with the hook head, thus, damage to the rope that may occur during jumping is diminished.

Figure 6C:
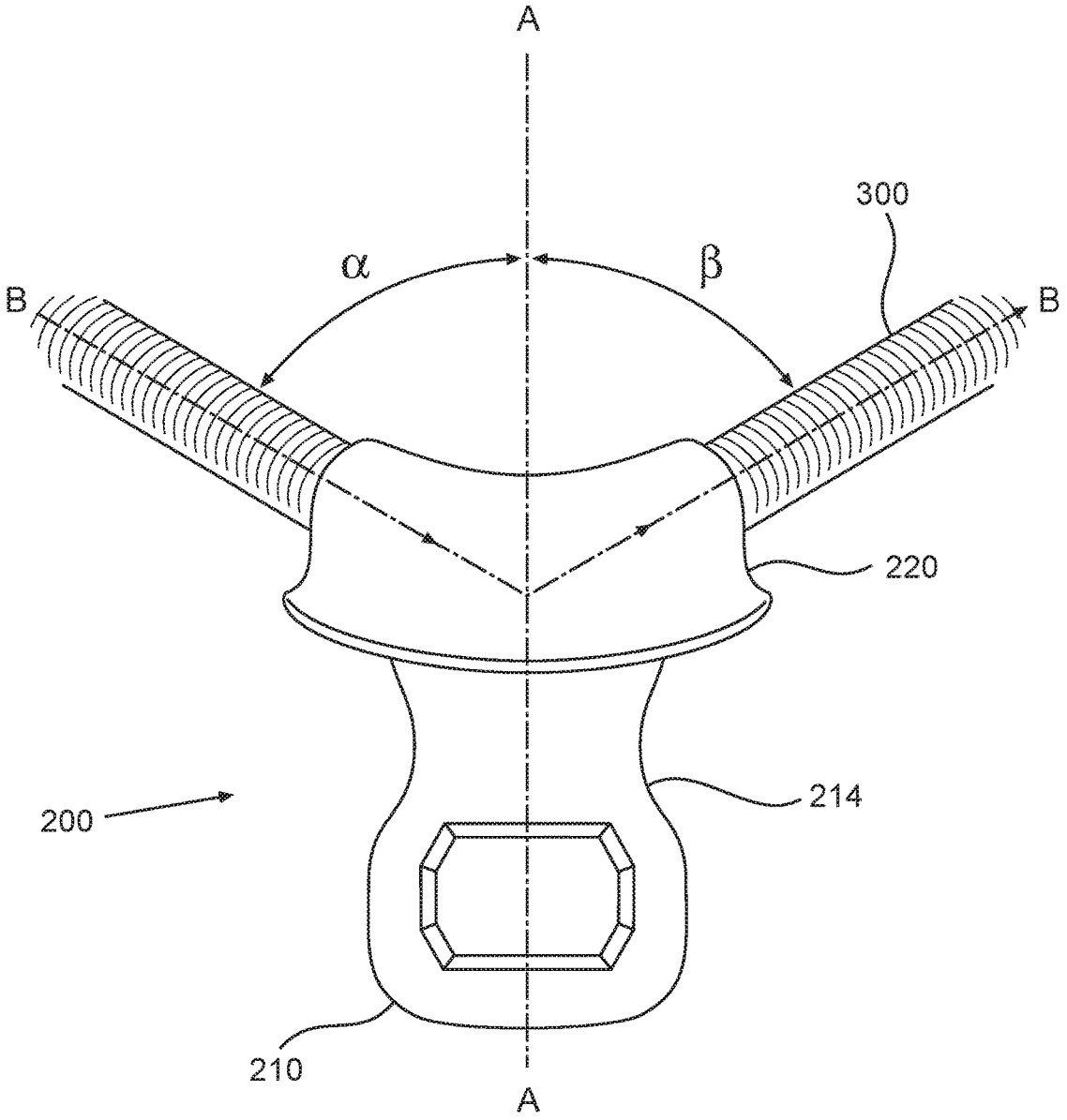
FIG. 6C is a schematic illustration of the approach and departure angles of the bungee rope into and out of the hook illustrated in FIG. 6B.

FIG. 6C is a schematic illustration of the approach and departure angles of the bungee rope 300 into and out of hook 200. In this Figure, the longitudinal axis of hook 200 is denoted as line A-A, while the longitudinal axis of the rope is denoted as line B-B. When the bungee rope goes into the hook the approach angle Alfa ($\alpha$) should be in the range of 30 to 70 degrees, as out of this range the rope may be damaged and be torn. When the bungee rope 300 goes out of the hook the departure angle beta ($\beta$) should also be in the range of 30 to 70 degrees, as out of this range the rope will be damaged. The approach angle and the departure angle may be similar or differ from each other; however both should be within the above range in order to keep the rope safe.

Figure 7A:
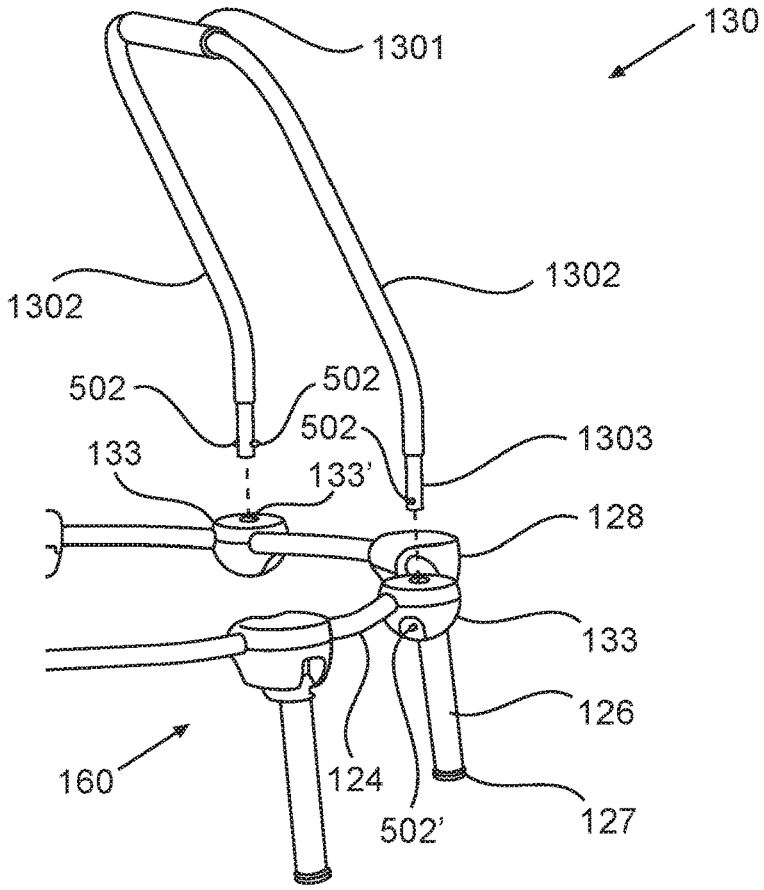
FIG. 7A is a partial side view of a frame with a detachable handle, which can be used in a bi-directional toy according to a further example of the presently disclosed subject matter.
Figure 7B:
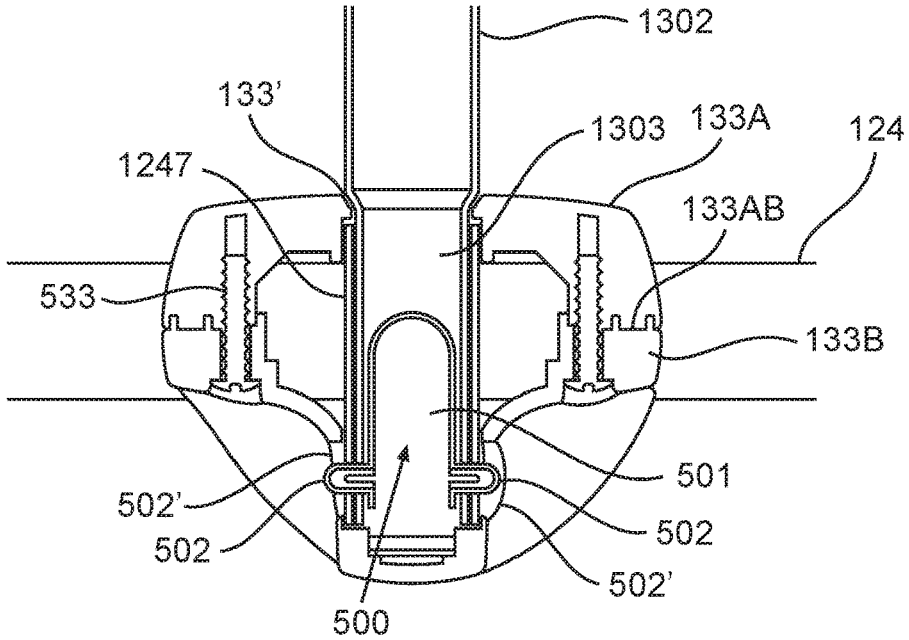
FIG. 7B is a cross section view of the attachment area of the handle to the frame and a covering connecting base.
Figure 7C:
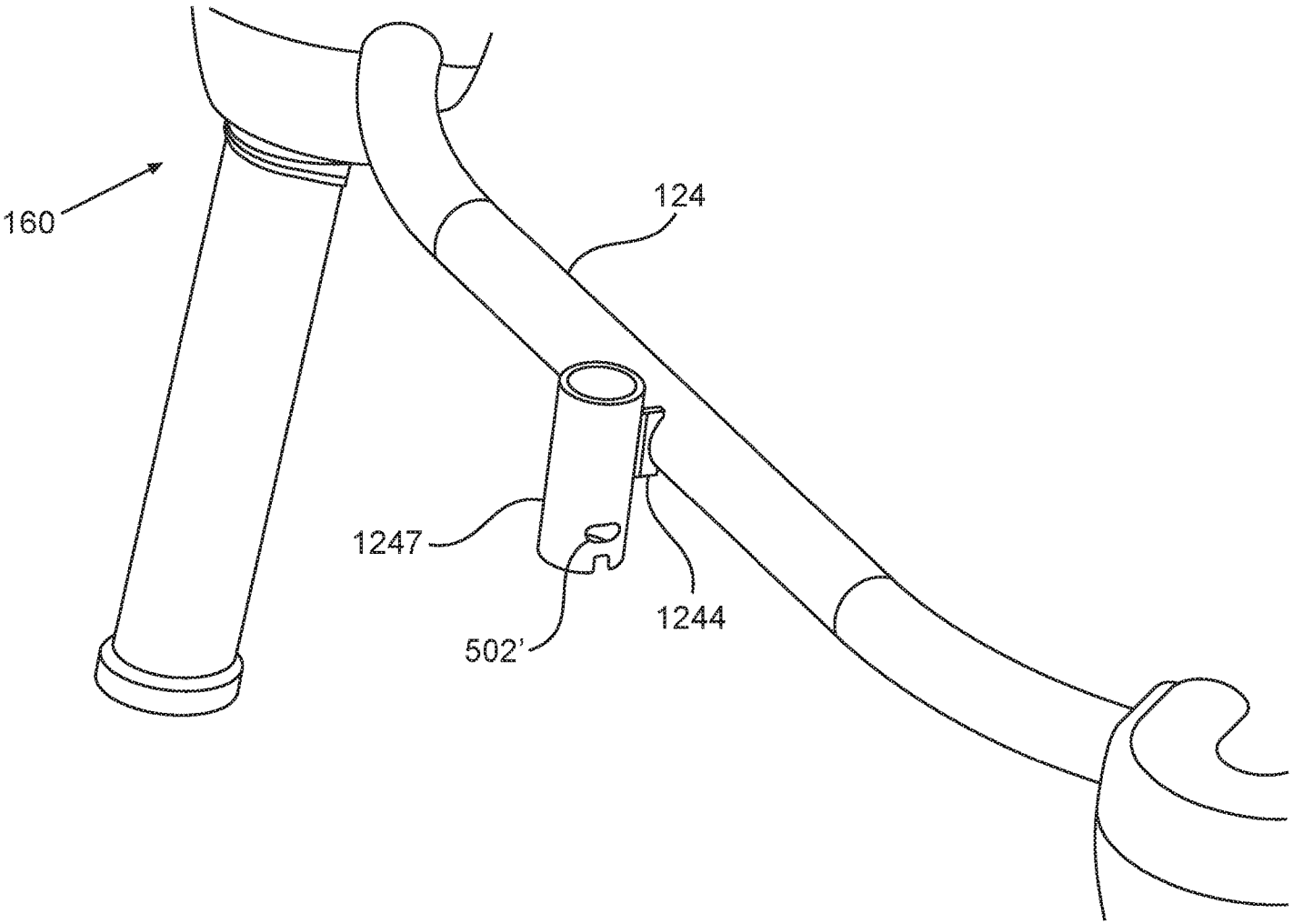
FIG. 7C is a close up view of the frame at the connection area of the handle.
Figure 8A:
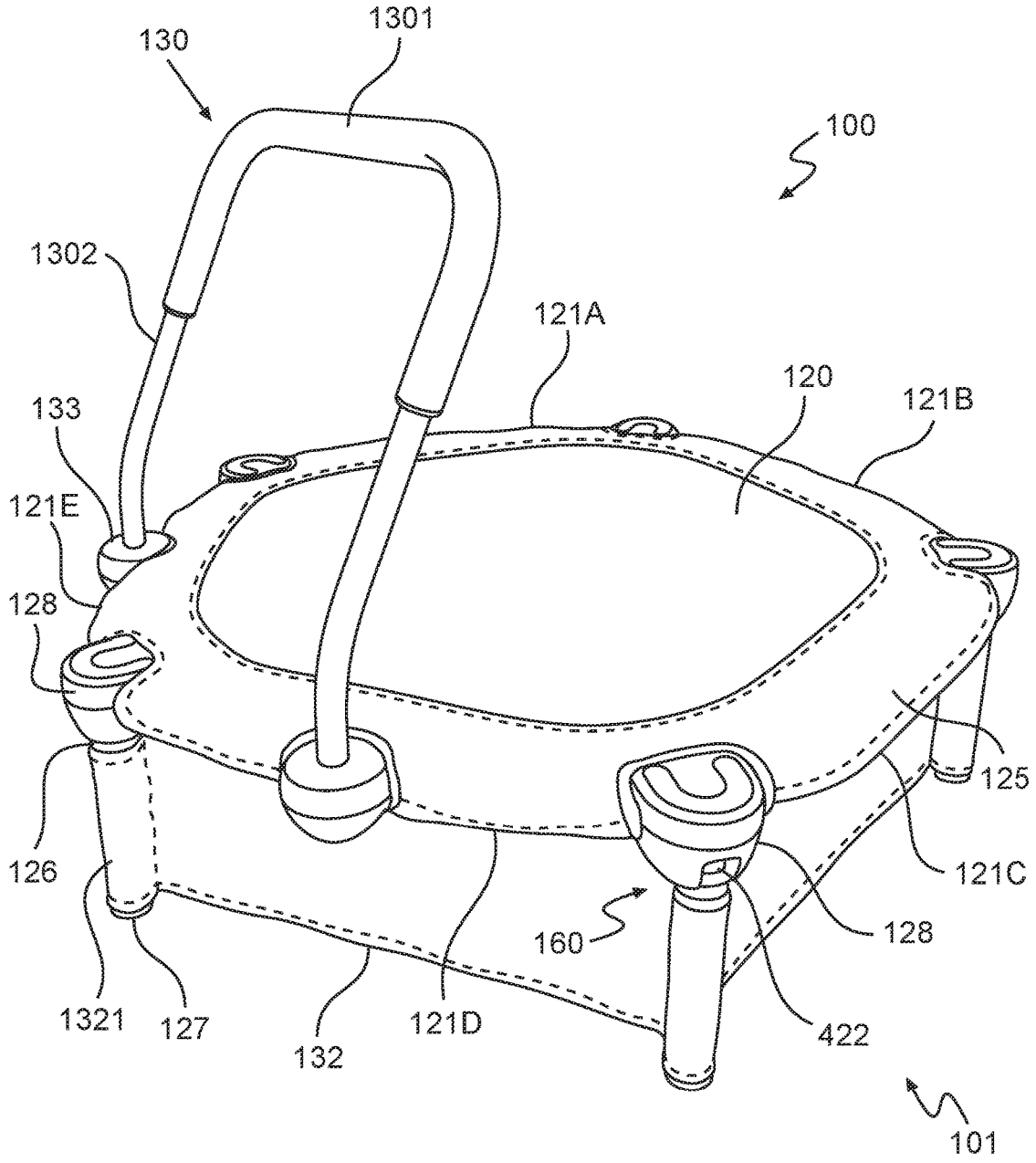
FIGS. 8A to 8G illustrate a bi-directional toy in accordance of a further example of the presently disclosed subject matter, which is identical to that shown in FIGS. 1A to 3B of PCT/IL2016/050059.
Figure 8B:
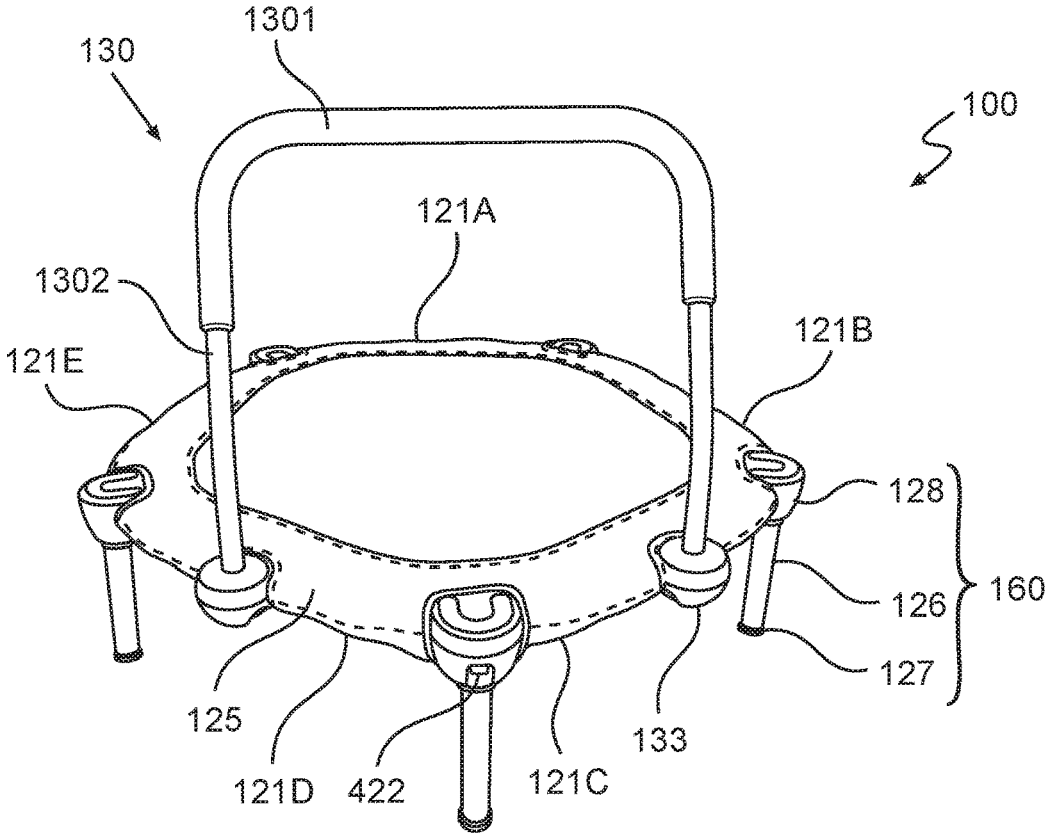
Figure 8C:
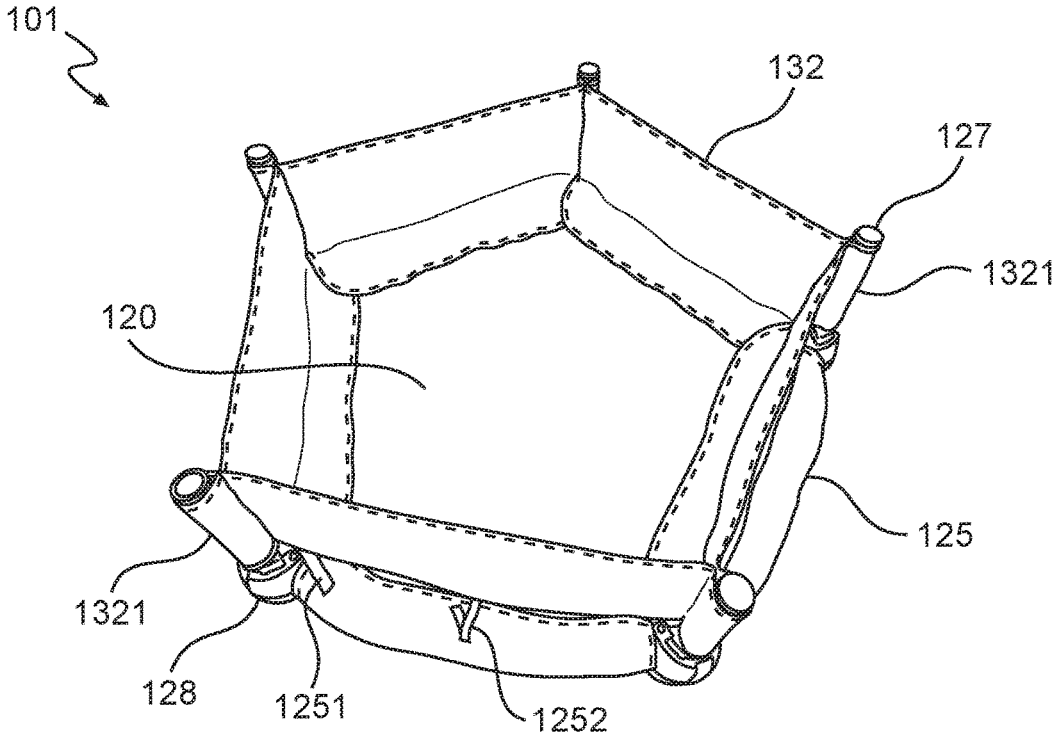
Figure 8D:
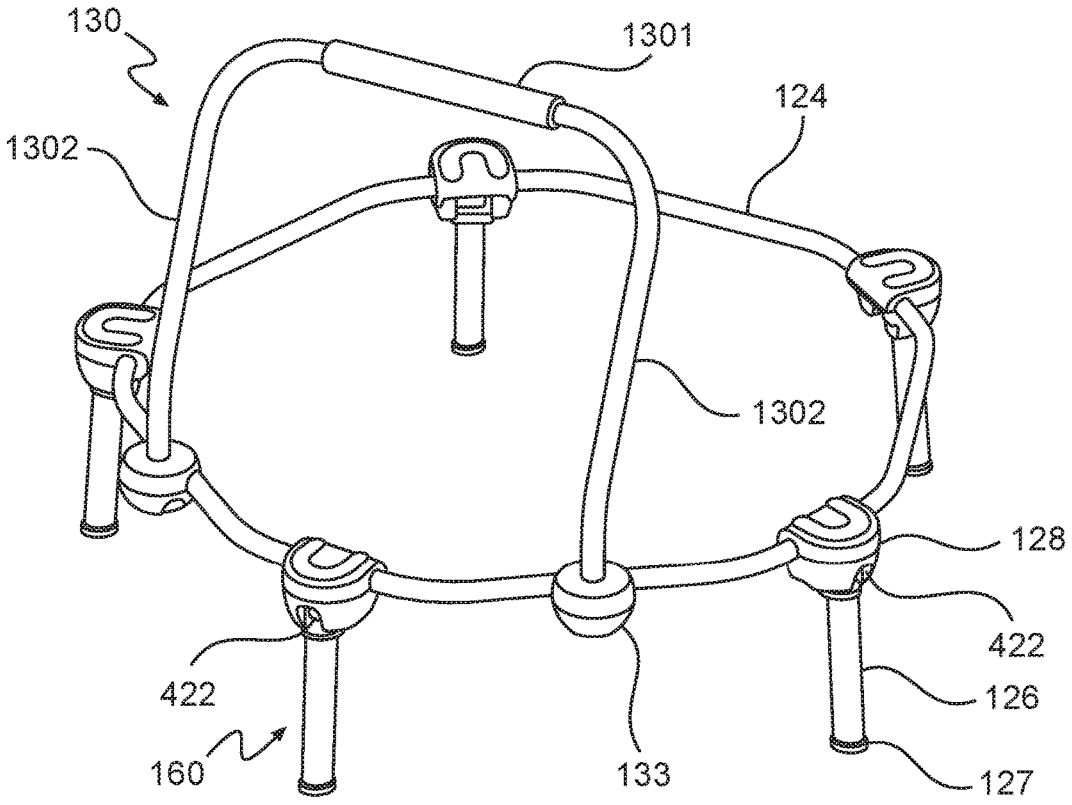
Figure 8E:
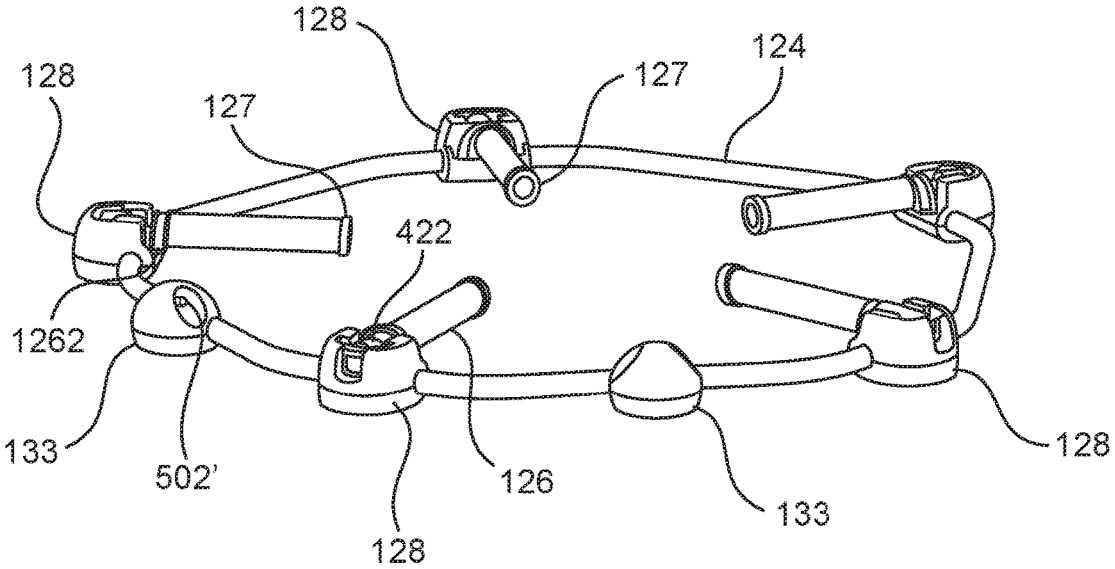
Figure 8F:
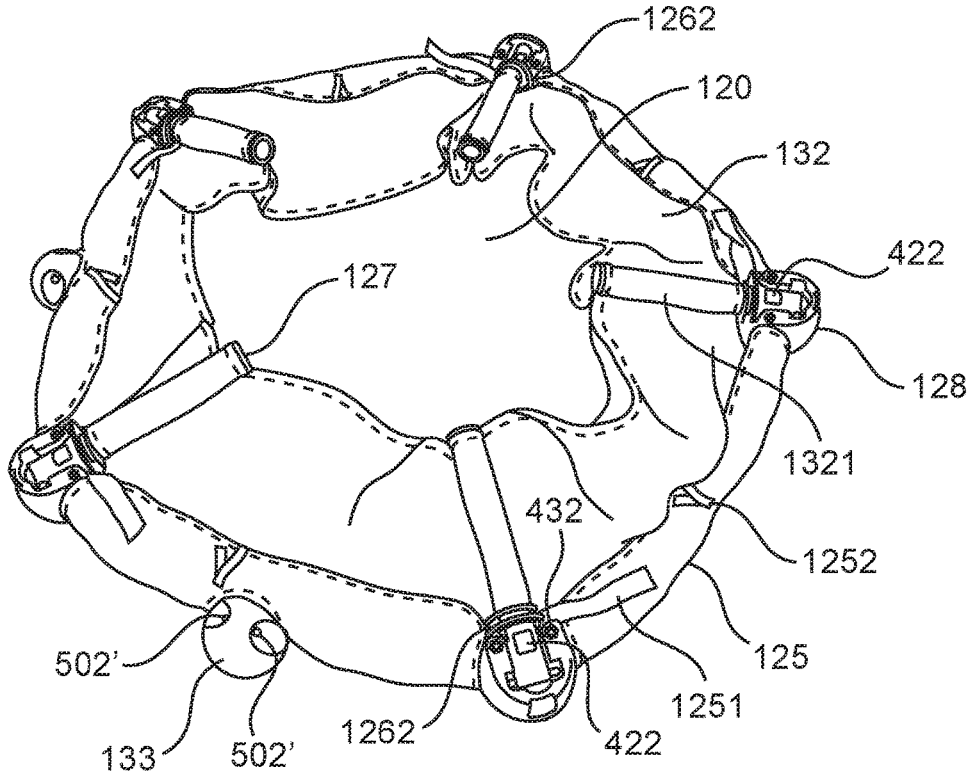
Figure 8G:
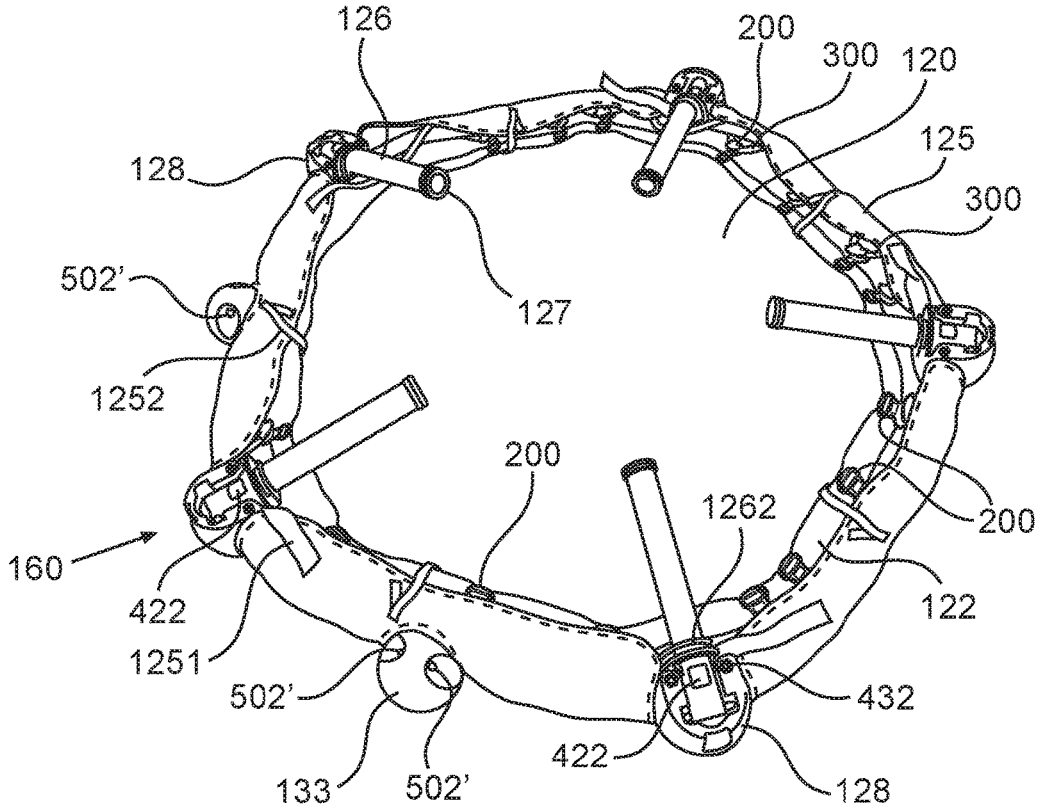

FIGS. 7A-7C are schematic illustrations showing the connection of the handle 130 to frame 124. The connection is established by insertion of the handle into an extended cylindrical body 1247 that is welded to frame 124 via extension 1244, wherein the cylindrical body and the connection area to frame 124 are covered by connecting body housing 133, one for each side of the handle. FIG. 7A is a partial side view of the trampoline skeleton with the detachable handle. FIG. 7B, is a cross section view of the attachment area of the handle into cylindrical body 1247 housed by connecting body housing 133 that is assembled on the frame of the trampoline. FIG. 7C is a close up view of the connection of cylindrical body 1247 welded to frame 124.

Handle 130 has an inversed "U shape and comprises a holding area 1301 and two parallel descending tubes 1302 each ends with narrower (embossing) area 1303 configured to be inserted into cylindrical body 1247 covered by connecting body housing 133 via opening 133'. Area 1303 comprises within it a be-directional spring 500 having a central body 501 and two pressable tips 502.

Connecting body housing 133 comprises two parts: an upper housing 133A and a bottom housing 133B, both parts are assembled onto cylindrical body 1247 extended from frame 124 and connected to each other by screws 533. The screws are positioned on both sides of opening 133' to provide strong and stable connection between connecting body housing 133 and frame 124. The connection area between the two parts 133A and 133B is show in the Figure as 133AB.

In order to connect handle 130 to the trampoline frame 124, the user should simply insert each embossing area 1303 into opening 133' and push the handle 130 downward through cylindrical body 1247 until the loaded springs reach a dedicated openings 502' and protrude out of bottom housing 133B. The structure of embossing area 1303 causes pressable tips 502 to be pressed inward, and when pressable tips 502 are reaching openings 502' they are automatically released and protrude out through openings 502' and shown from bottom housing 133B. At this state the handle is assembled and locked on frame 124.

In order to disassemble the handle from the trampoline an opposite action should be performed. The user should first press protruding tips 502 into opening 502' and pull the handle upward to eject embossing area 1303 from cylindrical body 1247. The handle is out when embossing area 1303 is fully removed from cylindrical body 1247. In the specific example the insertion and ejection actions should be performed for each side of handle 130.

In the cross section view of FIG. 7B, embossing area 1303 of handle 130 is shown while it is inserted into cylindrical body 1247 that is covered by connecting body housing 133. Bidirectional spring 500 is positioned within it in a releases, unloaded state as the two pressable tips 502 are un-pressed and protrude out of openings 502'. At this state the handle is locked onto the multifunctional trampoline frame. Also shown in this view are: the bidirectional spring body 501, handle tube 1302, and frame 124.

FIG. 7C schematically illustrates frame 124 welded to cylindrical body 1247 via extension 1244. Cylindrical body comprised two openings 502' for release of pressable tips 522 of spring 500. Cylindrical body 1247 is housed by connecting body 133 to provide this area an esthetic smooth look. Also shown in this view is leg assembly 160.

In some embodiments, the foldable bi-directional toy of the presently disclosed subject matter may be designed without a handle as the handle is an optional feature only.

In a further example, the foldable toy may be used in a single function as a foldable trampoline to be used at home and in gyms. In such embodiment the trampoline may also be designed without a handle.

Figure 9A:
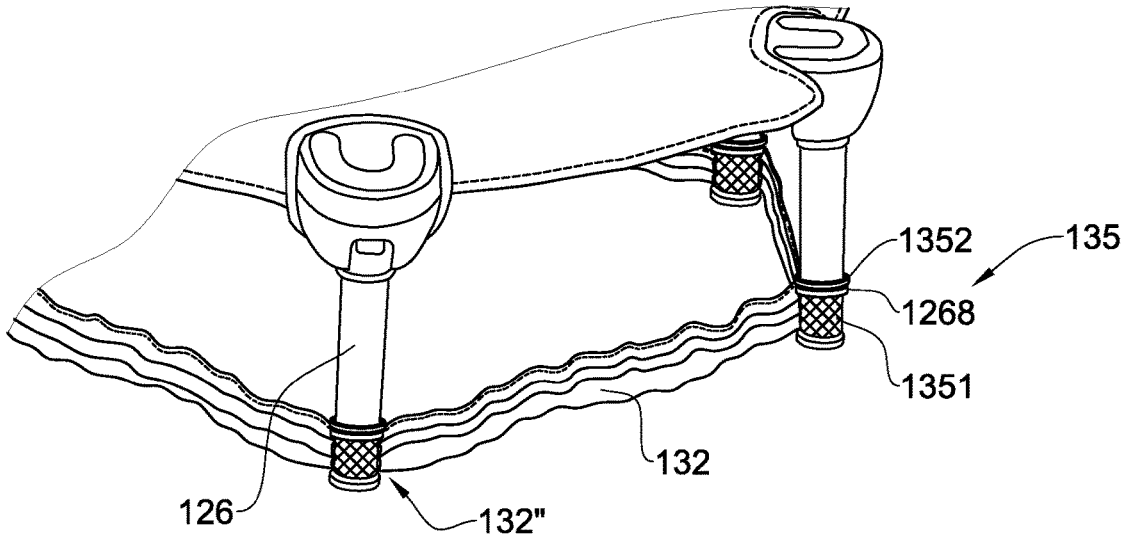
FIGS. 9A and 9B are partial schematic isometric views of a bi-directional toy in accordance with a further example of the presently disclosed subject matter, in its trampoline and non-trampoline forms, respectively.
Figure 9B:
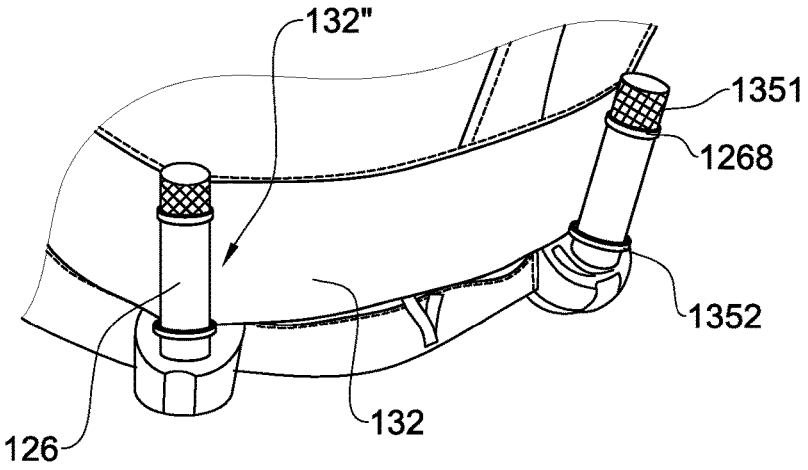

FIGS. 9A and 9B illustrates a bi-directional toy in accordance with a further embodiment, in which the encircling member 132 is attached to each of the legs 126 by specific attachment means 135 configured to hold the encircling member in a vertical state for its non-trampoline functioning of the device, and to allow the encircling member to collapse downwardly when the toy is used as a trampoline.

More particularly, each corner 132" of the encircling member 132 has a distal corner end, which when the encircling member 132 is attached to one of the legs 126, is fixed to the leg at a fixation location thereof adjacent the distal end of the leg by a securing member 1351, which can be in the form of a connecting strap secured around the leg 126 with a buckle or Velcro.

Each corner 132" of the encircling member 132 further has a proximal corner end provided with an embracing element 1352 to freely surround the leg 126 so as to be freely movable therealong between a first location, taken thereby when the toy is oriented for its non-trampoline use (FIG. 9B), in which proximal corner end is spaced to a maximal extent from the distal corner end and a second location taken by the proximal corner end when the toy is oriented for its trampoline use (FIG. 9A), in which the proximal corner end is spaced from the distal corner end to a minimal extent to expose a space beneath said bouncing mat 120 for being viewed. The movement of the embracing member 1352 between its first and second locations is obtained by its collapsing downwardly by gravity. The embracing member 1352 is of an annular shape with an inner diameter d greater than the outer diameter $D_1$ of the leg body adjacent its distal end.

The leg 126 can further be formed with a rib 1268 adjacent its distal end, to facilitate the fixation of the securing unit 1351 to the leg, when the device is used for its non-trampoline function. The outer diameter of the rib $D_2$ is greater than the inner diameter of the embracing unit d. The rib 1268 can be formed integrally with the leg 126.

Figure 10:
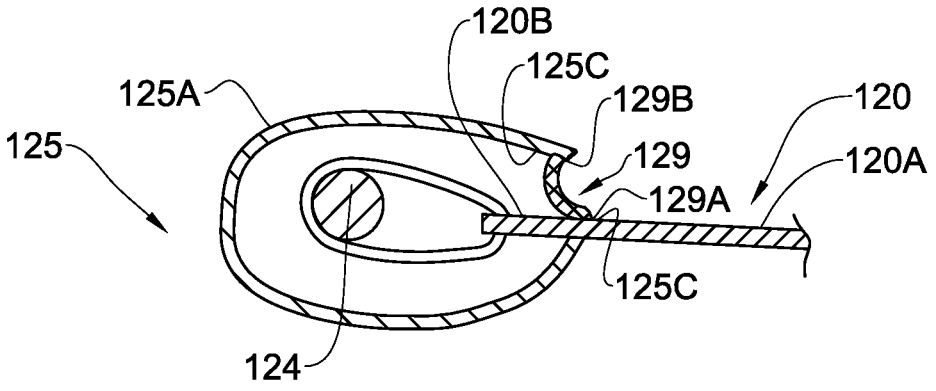
FIG. 10 is a partial schematic cross sectional view of a bi-directional toy in accordance with still another example of the presently disclosed subject matter.

FIG. 10 illustrates a bi-directional toy in accordance with a further embodiment, in which the toy is provided a safety barrier 129 between the bouncing mat 120 and the cover 125 covering the frame and elements connecting the bouncing mat thereto. These elements can be any of those described above or any other suitable elements. With the bouncing mat 120 having a central area 120A and a peripheral area 120B connected to the frame 124 by the connection elements, the cover 125 has a sufficient radial extension to cover, in addition to the frame and the connection elements, also the peripheral area 120B of the bounce mat 120. In particular, the cover 125 covers the frame with a cover frame portion 125A and covers the peripheral area of the bouncing mat with a cover peripheral portion 125B.

The barrier 129 has an upper edge 129B integrally connected to an innermost edge 125C of the cover peripheral portion 125B, and a lower edge 129A integrally connected to the bouncing mat 120 along an area 120C of merger between the central and peripheral areas 120A and 120B, all along the entire circumference of the central area 120A. The integral connection can be achieved, e.g. by sawing the barrier to the cover and the bouncing mat. The barrier 129 thus separates between the central area 120A and the peripheral area 120B of the bouncing mat and constitutes a partition, behind which all elements participating in the connection of the bouncing mat 120 to the frame 124 are hidden from being accessed by the user disposed at the central area of the bounce mat 120A. The barrier can be made of the same material as the cover or the mat, or it can be made of a different material, e.g. an elastic textile.

Figure 11:
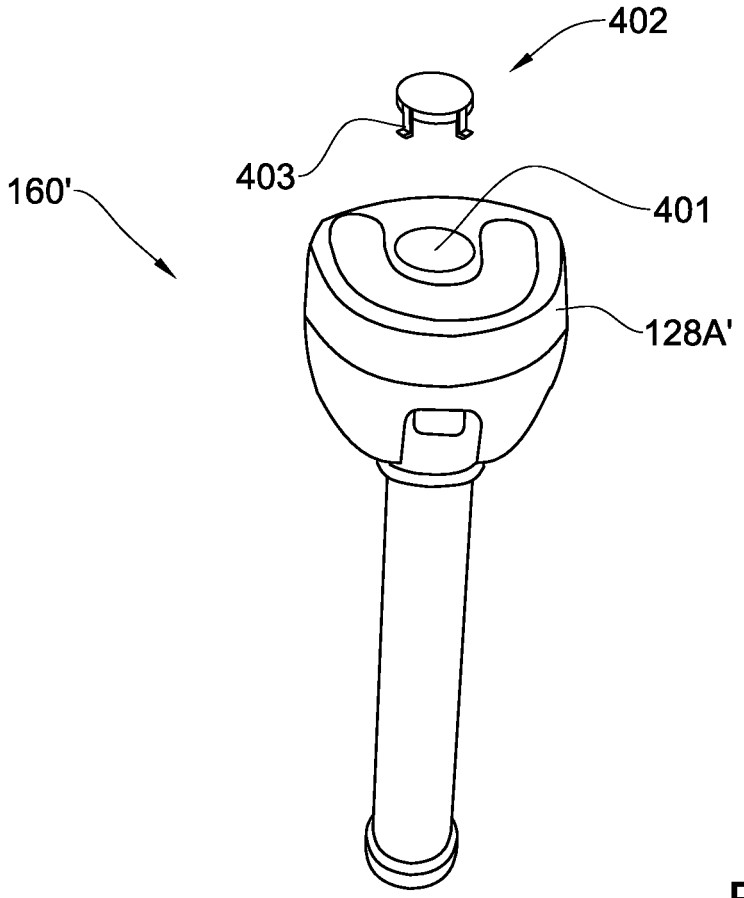
FIG. 11 is a schematic isometric view of a leg assembly, which can be used in a bi-directional toy, in accordance with a further example of the presently disclosed subject matter, with a space formed in a top area the leg being uncovered.

FIG. 11 illustrates an optional design of a leg assembly 160' that can be used in a bi-directional toy according to any of the above embodiments, which differs from the leg assembly 160 shown in FIGS. 4, 5A and 5B in that a space 401 is formed in the top housing portion 128A', which accommodates a wheel mounting device (not shown) for fixedly securing a wheel thereto when the bi-directional toy is to be used in its non-trampoline function, so as to provide mobility to the bi-directional toy.

The space 401 is covered by a cover 402 that is clicked onto top housing portion 128N via snap fit 403. When the bi-directional toy is in the trampoline operation, the cover 402 provides an additional soft layer if the user accidently falls on the housing 128 of the leg assembly. When the bi-directional toy is in the non-trampoline operation without wheels, the rubber provides an additional anti-slip feature to the leg assembly. The cover can be made of rubber or any other flexible material.

It should be clear that the description of the embodiments and attached Figures set forth in this specification serves only for a better understanding of the presently disclosed subject matter, without limiting its scope. It should also be clear that a person skilled in the art, after reading the present specification could make adjustments or amendments to the attached Figures and above described embodiments that would still be covered by the present presently disclosed subject matter.

The invention claimed is:

1. A bi-directional device configured and operable to be used as a trampoline and further to be used, upon turning over the bi-directional toy, in at least one of the following functions: a playpen-like device, a water pool, or a sphere pool, at least when assembled for at least one function thereof, the bi-directional device comprising:

a. a frame having a plurality of leg connection zones spaced from each other;

b. a bouncing mat attached to the frame, c. a plurality of legs each having a proximal end associated with one leg connection zone of the frame and a distal end spaced from the frame so as to enable holding the frame elevated from a horizontal base surface and jumping thereon, when the distal ends of the plurality of legs are in contact with and are supported by the base surface, and to serve as a basis for dressing onto the legs via the distal ends of the legs an encircling member for creating a delimited area when used as the non-trampoline device; and d. the encircling member configured to be dressed onto each of the plurality of legs for creating a delimited area to allow non-trampoline functioning of the device, when the bi-directional device is turned over so that the frame is disposed adjacent or on the base surface and the plurality of legs protrude upwardly therefrom with the distal ends of the legs spaced from the base surface, wherein the distal end and a leg body of at least one of the plurality of legs are free of permanent fixation to any other leg assembly or to the frame so as to permit the dressing of the encircling member onto the distal end of the at least one of the plurality of legs.

2. The bi-directional device according to claim 1, wherein the encircling member is formed with a plurality of walls meeting at least along a part of a height thereof at corners, the number of the corners and length of the walls therebetween corresponding, respectively, to the number of the legs and spacing between the legs, the encircling member being configured to be dressed on the legs along said corners.

3. The bi-directional device according to claim 2, wherein each of the corners of the encircling member is formed with a sleeve configured to receive therein one of the legs when inserted therein with the distal end thereof.

4. The bi-directional device according to claim 3, wherein each of the sleeves extends at least partially along a corresponding corner and protrudes outwardly therefrom.

5. The bi-directional device according to claim 1, wherein the bi-directional device is foldable at least by changing orientation of the plurality of legs relative to the frame and thereby bringing the plurality of legs into a non-operational state.

6. The bi-directional device according to claim 5, wherein in the non-operational state of the legs, the legs are configured to have an orientation, in which the distal ends of the legs are disposed closer to each other than in an operational state of the legs, which the legs are configured to have when the device is unfolded.

7. A bi-directional device configured and operable to be used as a trampoline and further to be used, upon turning over the bi-directional toy, in at least one of the following functions: a playpen-like device, a water pool, or a sphere pool, at least when assembled for at least one function thereof the bi-directional device comprising:

a. a frame having a plurality of leg connection zones spaced from each other;

b. a bouncing mat attached to the frame, c. a plurality of legs each having a proximal end associated with one leg connection zone of the frame and a distal end spaced from the frame, the legs being configured:

i. to have an operational state to enable holding the frame elevated from a horizontal base surface and jumping thereon when the distal ends of the legs are in contact with and are supported by the base surface, and to serve as a basis for dressing onto the legs via the distal ends of the legs an encircling member for creating a delimited area when used as the non-trampoline device; wherein in the operational state of the legs, the distal ends of the legs are spaced from each other to a maximal extent; and ii. to fold the legs relative to the frame, thereby bringing the legs into a non-operational state, in which the spacing between the distal ends of the legs is reduced; and d. the encircling member configured to be dressed onto each of the plurality of legs, for creating a delimited area to allow non-trampoline functioning of the device, when the bi-directional device is turned over so that the frame is disposed adjacent or on the base surface and the plurality of legs protrude upwardly therefrom with the distal ends of the legs spaced from the base surface.

8. The bi-directional device according to claim 7, wherein the distal end and a leg body of at least one of the plurality of legs are free of permanent fixation to any other leg assembly or to the frame.

9. The bi-directional device according to claim 7, wherein the encircling member is formed with a plurality of walls meeting at least along a part of a height thereof at corners, the number of the corners and length of the walls therebetween corresponding, respectively, to the number of the legs and spacing between the legs, the encircling member being configured for being dressed onto the legs along said corners.

10. The bi-directional device according to claim 9, wherein each of the corners of the encircling member is formed with a sleeve configured to receive therein one of the legs when inserted therein with the distal end thereof.

11. The bi-directional device according to claim 10, wherein each of the sleeves extends at least partially along a corresponding corner and protrudes outwardly therefrom.

* * * * *